US009646491B2

(12) United States Patent
Shimura et al.

(10) Patent No.: US 9,646,491 B2
(45) Date of Patent: May 9, 2017

(54) INFORMATION SYSTEM AND IN-VEHICLE TERMINAL DEVICE

(71) Applicant: PANASONIC INTELLECTUAL PROPERTY MANAGEMENT CO., LTD., Osaka (JP)

(72) Inventors: Takuma Shimura, Osaka (JP); Yuji Mizuguchi, Kanagawa (JP); Kazuoki Otani, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 19 days.

(21) Appl. No.: 14/405,581

(22) PCT Filed: Oct. 30, 2012

(86) PCT No.: PCT/JP2012/006943
§ 371 (c)(1),
(2) Date: Dec. 4, 2014

(87) PCT Pub. No.: WO2013/183095
PCT Pub. Date: Dec. 12, 2013

(65) Prior Publication Data

US 2015/0170431 A1 Jun. 18, 2015

(30) Foreign Application Priority Data

Jun. 5, 2012 (JP) ..... 2012-127768

(51) Int. Cl.
*G08G 1/01* (2006.01)
*G08G 1/0967* (2006.01)
(Continued)

(52) U.S. Cl.
CPC ..... *G08G 1/0112* (2013.01); *G07C 5/008* (2013.01); *G08G 1/0141* (2013.01); *G08G 1/0962* (2013.01); *G08G 1/096775* (2013.01)

(58) Field of Classification Search
CPC .... G07C 5/008; G08G 1/0112; G08G 1/0962; G08G 1/0141; G08G 1/096775
See application file for complete search history.

(56) References Cited

U.S. PATENT DOCUMENTS 4,456,903 A * 6/1984 Kishi ..... G02B 6/3604 180/78
5,148,153 A 9/1992 Haymond
(Continued)

FOREIGN PATENT DOCUMENTS

EP 2416120 A1 2/2012
JP 2005-222193 A 8/2005
(Continued)

OTHER PUBLICATIONS

Garmin nuvi 30/40/50 owner's manual, Aug. 2011, 190-01336-00 Rev. A, cover page, pp. 12 and 13, and back page.*
(Continued)

*Primary Examiner* — Dale W Hilgendorf
(74) *Attorney, Agent, or Firm* — Pearne & Gordon, LLP

(57) ABSTRACT

An information system capable of utilizing information in which a user evaluation pertaining to the environment or conditions surrounding a traveling vehicle is highly precise (very near real time). The information system (100) comprises an onboard terminal device (110) for outputting information obtained by a user's input operation, a communication terminal device (120) for transmitting the information outputted by the onboard terminal device (110) to the exterior, and an information center (130) for classifying and delivering the information received from the onboard terminal device (110). The onboard terminal device (110)
(Continued)

varies the level of detail of the information that the user is allowed to input in accordance with the speed of the vehicle or the presence/absence of a passenger other than the driver of the vehicle.

13 Claims, 22 Drawing Sheets

(51) Int. Cl.
*G08G 1/0962* (2006.01)
*G07C 5/00* (2006.01)

(56) References Cited

U.S. PATENT DOCUMENTS 6,122,682 A * 9/2000 Andrews ..... G08G 1/0962 701/431
6,330,499 B1 * 12/2001 Chou ..... G07C 5/008 701/31.4
6,438,471 B1 * 8/2002 Katagishi ..... G07C 5/008 701/31.4
2002/0156558 A1 * 10/2002 Hanson ..... G07C 5/008 701/29.3
2002/0177926 A1 * 11/2002 Lockwood ..... G06Q 10/20 701/31.5
2004/0090346 A1 * 5/2004 Simonds ..... G08G 1/0962 340/905
2007/0005202 A1 * 1/2007 Breed ..... G07C 5/008 701/29.1
2008/0071465 A1 * 3/2008 Chapman ..... G08G 1/0129 701/117
2009/0177379 A1 * 7/2009 Jones ..... G08G 1/096791 701/408
2009/0271101 A1 * 10/2009 Relyea ..... G08G 1/096775 701/118
2010/0274440 A1 * 10/2010 Kim ..... G07C 5/008 701/31.4
2011/0035144 A1 2/2011 Okamoto et al.
2012/0223842 A1 * 9/2012 Schunder ..... G07C 5/008 340/936

FOREIGN PATENT DOCUMENTS

JP 2009-040243 A 2/2009
JP 2009-121879 A 6/2009
JP 2009-257832 A 11/2009
JP 2010-036871 A 2/2010
JP 2011-168139 A 9/2011
JP 2012-037381 A 2/2012
JP 2012-078497 A 4/2012
WO 2011-055470 A1 5/2011

OTHER PUBLICATIONS

Supplementary European Search Report for Application No. 12878301.6 dated May 11, 2015.
International Search Report for Application No. PCT/JP2012/006943.

* cited by examiner

INFORMATION SYSTEM AND IN-VEHICLE TERMINAL DEVICE

This application is entitled to and claims the benefit of Japanese Patent Application No. 2012-127768 dated Jun. 5, 2012, the disclosure of which including the specification, drawings and abstract is incorporated herein by reference in its entirety.

TECHNICAL FIELD

The present invention relates to an information system in which an information center and a communication terminal device mounted (or placed) in a vehicle perform bidirectional and real-time wireless communication and also relates to an in-vehicle terminal device.

BACKGROUND ART

Conventionally, an information system is known in which an information center searches for a region in which a vehicle density is high on the basis of location information transmitted from vehicles, and transmits a question about a region satisfaction level to the vehicles in the found region (see, for example, PTL 1). In this information system, the information center further receives the answers for the question, and posts the information relating to the received satisfaction level on the network. The vehicles can receive the information.

CITATION LIST

Patent Literature

PTL 1
Japanese Patent Application Laid-Open No. 2005-222193

SUMMARY OF INVENTION

Technical Problem

However, in the conventional information systems, questions are transmitted only to stopped vehicles in the searched region or vehicles which are in the searched region and in which a passenger other than the driver exists. Consequently, the user cannot voluntarily transmit the answer for the question from the vehicle side, resulting in lack of a real time property.

An object of the present invention is to provide an information system and an in-vehicle terminal device that allows for an operation in which location information of a vehicle and brief user information are transmitted, and then detailed user information is added to the transmitted brief user information when the vehicle is stopped or a passenger other than the driver exists in the vehicle.

Solution to Problem

To achieve the above-mentioned object, embodiments of the present invention include a communication terminal device having a control section and a wireless communication section; an in-vehicle terminal device having a display section, a control section, a user interface section, a vehicle information detection section, and a location information detection section; and an information center having a wireless communication section, a control section.

Advantageous Effects of Invention

According to the present invention, a user can voluntarily transmit information to the information center from the vehicle side, and thus real time information update can be achieved.

DESCRIPTION OF EMBODIMENTS

Embodiment 1

Figure 1:
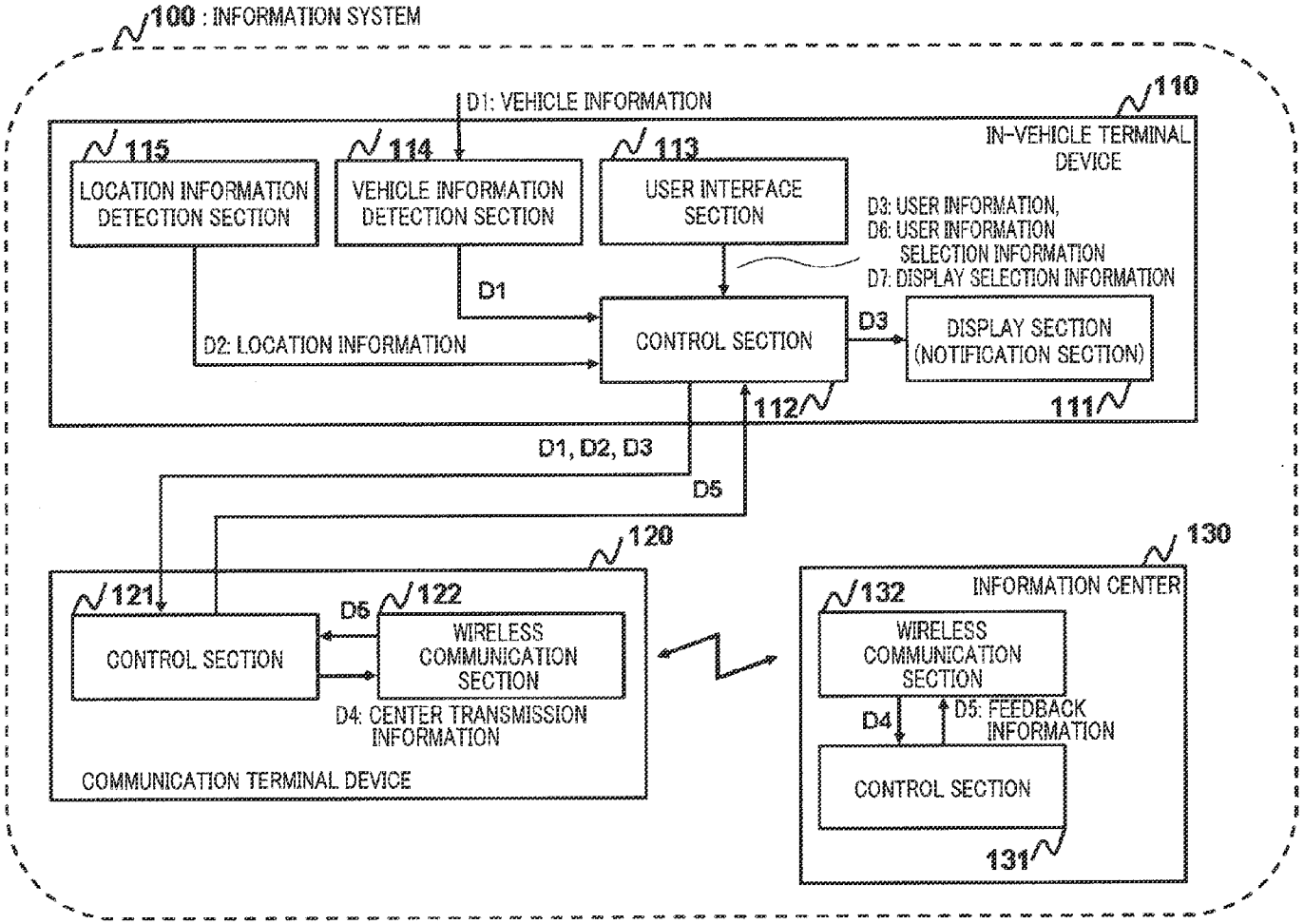
FIG. 1 is a configuration diagram of information system 100 in Embodiment 1 of the present invention.

In the following, information system 100 in Embodiment 1 of the present invention will be described. First, vehicle information D1, location information D2, user information D3, center transmission information D4, feedback information D5, user information selection information D6, and display selection information D7, which are used in the following description, will be described.

Vehicle information D1 is information provided from the vehicle. Vehicle information D1 represents a vehicle speed, an operation state of a brake, an operation state of a wiper, a steering angle of a steering, the position of a passenger in the vehicle, the number of people in the vehicle, and the like.

Location information D2 is information that is obtained by utilizing a GPS antenna, and represents the position of the vehicle.

User information D3 is information that is input by the user. For example, user information D3 is information representing road conditions such as a traffic volume, a lane regulation in association with a road closure or a road construction, and the like of the road where the vehicle travels, which are perceived by the user in the vehicle. In addition, for example, user information D3 is information representing impressions and opinions for the surrounding condition such as the scenery and shops of the road where the vehicle travels, and the like.

Center transmission information D4 is information generated by communication terminal device 120. Center transmission information D4 includes at least location information D2 and user information D3, and allows for determination of the association with location information D2 on information center 130 side. It is to be noted that vehicle information D1 may be included in center transmission information D4. In addition, center transmission information D4 may be generated by in-vehicle terminal device 110.

Feedback information D5 is information generated by information center 130. Feedback information D5 is information in which center transmission information D4 transmitted from a plurality of vehicles is sorted by (or collected for statistics on) traffic volume, road conditions, a surrounding condition, and the like. It is to be noted that, in feedback information D5, in the case where there are pieces of information whose content can be determined to be the same, weight information may be added to prioritize the information used for displaying.

User information selection information D6 is information input by the user. User information selection information D6 is information used for selecting, from pieces of brief user information D3 input by the user, brief user information D3 to which detailed user information D3 is added.

Display selection information D7 is information input by the user. Display selection information D7 is information used for selecting whether to display feedback information D5 transmitted from information center 130 on display section 111 of in-vehicle terminal device 110.

Next, information system 100 in Embodiment 1 of the present invention is described with reference to the drawings. FIG. 1 is the configuration diagram of information system 100 in Embodiment 1 of the present invention.

In FIG. 1, information system 100 includes in-vehicle terminal device 110, communication terminal device 120, and information center 130. In-vehicle terminal device 110 is provided with a function of detecting vehicle information D1 and location information D2; a function of acquiring, displaying, and inputting user information D3; a function of acquiring user information selection information D6; and a function of acquiring display selection information D7. Communication terminal device 120 transmits information (D1 to D3) from in-vehicle terminal device 110, or receives information (D5) from information center 130. Information center 130 is a device for receiving information from vehicles (D4), collecting the received information, and transmitting information to vehicles (D5).

Here, the term "collection of information" means the operation of information center 130 in which the received data is sorted by (or collected for statistics on) the traffic volume, road conditions, and surrounding condition.

It is to be noted that, in information center 130, as information is received from a plurality of the vehicles having in-vehicle terminal device 110 and communication terminal device 120, the amount of information collected in information center 130 is increased, thus improving the reliability of information. In this manner, the information transmitted from information center 130 can be used as useful information for the users who received the information from information center 130.

In-vehicle terminal device 110 and communication terminal device 120 are provided in a vehicle such as an automobile (or placed in a vehicle), and information center 130 is provided outside a vehicle. For example, information center 130 is provided in an office that provides service, and the like.

In-vehicle terminal device 110 detects vehicle information D1 and location information D2, acquires and stores user information D3 input by the user, and transmits the information to communication terminal device 120. In addition, in-vehicle terminal device 110 receives feedback information D5 received from information center 130 by communication terminal device 120, and displays the information on the basis of display selection information D7. Here, in-vehicle terminal device 110 is a car navigation device, for example.

In-vehicle terminal device 110 includes display section (notification section) 111, control section 112, user interface section 113, vehicle information detection section 114, and location information detection section 115. Display section (notification section) 111 is, for example, a display. Control section 112 is composed of a microcomputer, ROM and RAM as storage sections, and the like, for example. User interface section 113 is composed of a touch panel on the display, a remote controller, a steering switch or other switches. User interface section 113 acquires user information D3, user information selection information D6, and display selection information D7. Vehicle information detection section 114 detects vehicle information D1. Location information detection section 115 detects location information D2.

The microcomputer of control section 112 executes a computer program which is stored in the ROM and configured to perform a control process, by using the RAM as a work area. At this time, the microcomputer of control section 112 temporarily stores vehicle information D1, location information D2, and user information D3 in the RAM area, and temporarily stores feedback information D5 received from the communication terminal device.

Communication terminal device 120 is configured to receive user information D3, and location information D2 and vehicle information D1 (in association with user information D3) from in-vehicle terminal device 110, convert the information into center transmission information D4, and transmit center transmission information D4 to information center 130.

In addition, communication terminal device 120 is configured to receive feedback information D5 collected by information center 130. Here, as communication terminal device 120, a mobile phone, a smartphone or the like can be utilized, for example.

Communication terminal device 120 is composed of control section 121 and wireless communication section 122. Control section 121 is composed of a microcomputer, ROM and RAM as storage sections, and the like, for example. Under the instruction of control section 121, wireless communication section 122 transmits center transmission information D4, or receives feedback information D5 from information center 130.

The microcomputer of control section 121 executes a computer program which is stored in the ROM and configured to perform a control process, by using the RAM as a work area. At this time, the microcomputer of control section 121 temporarily stores information transmitted from in-vehicle terminal device 110 (D1 to D3), and information (D5) transmitted from information center 130, in the RAM area.

Information center 130 receives and collects center transmission information D4 transmitted from vehicles, and transmits feedback information D5 to the vehicles so as to provide feedback on the collected information to the vehicles. Here, information center 130 is a cloud, a file server or the like, for example.

Information center 130 is composed of control section 131 and wireless communication section 132. Control section 131 is composed of a microcomputer, ROM and RAM as storage sections, and the like, for example. Wireless communication section 132 receives center transmission information D4 from communication terminal device 120.

Next, the processing and operation of information system 100 having the above-mentioned configuration are described.

Figure 2:
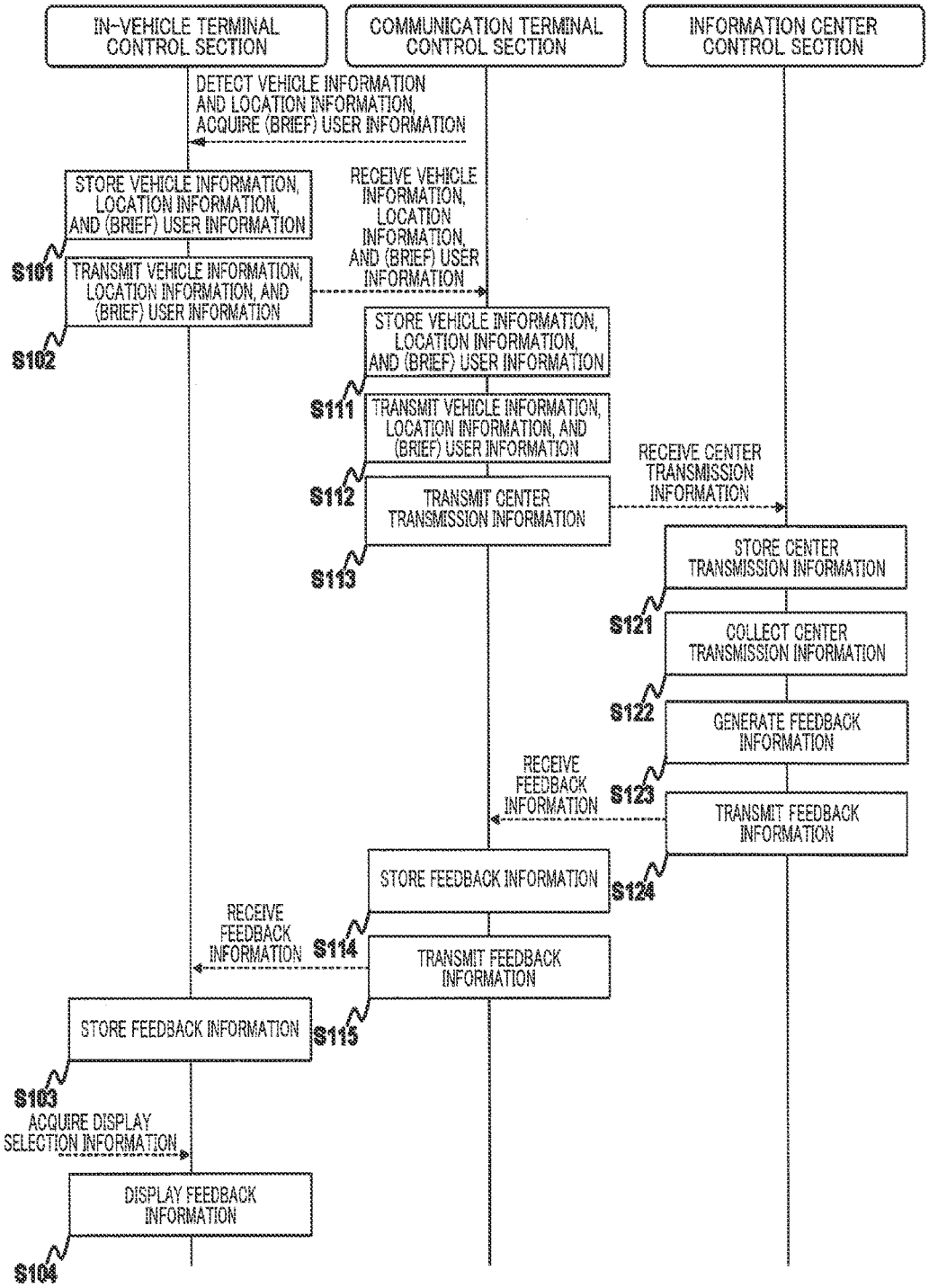
FIG. 2 is a flow chart for describing a transmission of brief user information D3, and a reception of feedback information D5 in information system 100 in Embodiment 1 of the present invention.

FIG. 2 is a flow chart of a transmission of brief user information D3, and a reception of feedback information D5 in information system 100 in Embodiment 1 of the present invention.

First, with reference to FIG. 2, the flow of the whole process of information system 100 is described. As illustrated in FIG. 2, upon detecting vehicle information D1 and location information D2 and acquiring brief user information D3, control section 112 of in-vehicle terminal device 110 stores the information in the RAM area (step S101), and transmits the information to control section 121 of communication terminal device 120 (step S102).

Upon receiving vehicle information D1, location information D2, and brief user information D3, control section 121 of communication terminal device 120 stores the information in the RAM area (step S111), and converts the information into center transmission information D4 (step S112). Then, control section 121 establishes a communication between wireless communication section 122 of communication terminal device 120 and wireless communication section 132 of information center 130, to thereby transmit center transmission information D4 to control section 131 of information center 130 (step S113).

Upon receiving center transmission information D4, control section 131 of information center 130 stores the information in the RAM area (step S121), collects the information on the basis of center transmission information D4 transmitted from a plurality of vehicles (step S122), and generates feedback information D5 (step S123). Then, control section 131 establishes a communication between wireless communication section 132 of information center 130 and wireless communication section 122 of communication terminal device 120, to thereby transmit feedback information D5 to control section 121 of communication terminal device 120 (step S124).

Upon receiving feedback information D5 from information center 130, control section 121 of communication terminal device 120 stores feedback information D5 in the RAM area (step S114), and transmits the information to control section 112 of in-vehicle terminal device 110 (step S115).

Upon receiving feedback information D5 from information center 130 through communication terminal device 120, control section 112 of in-vehicle terminal device 110 stores feedback information D5 in the RAM area in control section 112 of in-vehicle terminal device 110 (step S103). Then, in accordance with display selection information D7, control section 112 controls display section 111 to display the content representing feedback information D5 (step S104).

Figure 3:
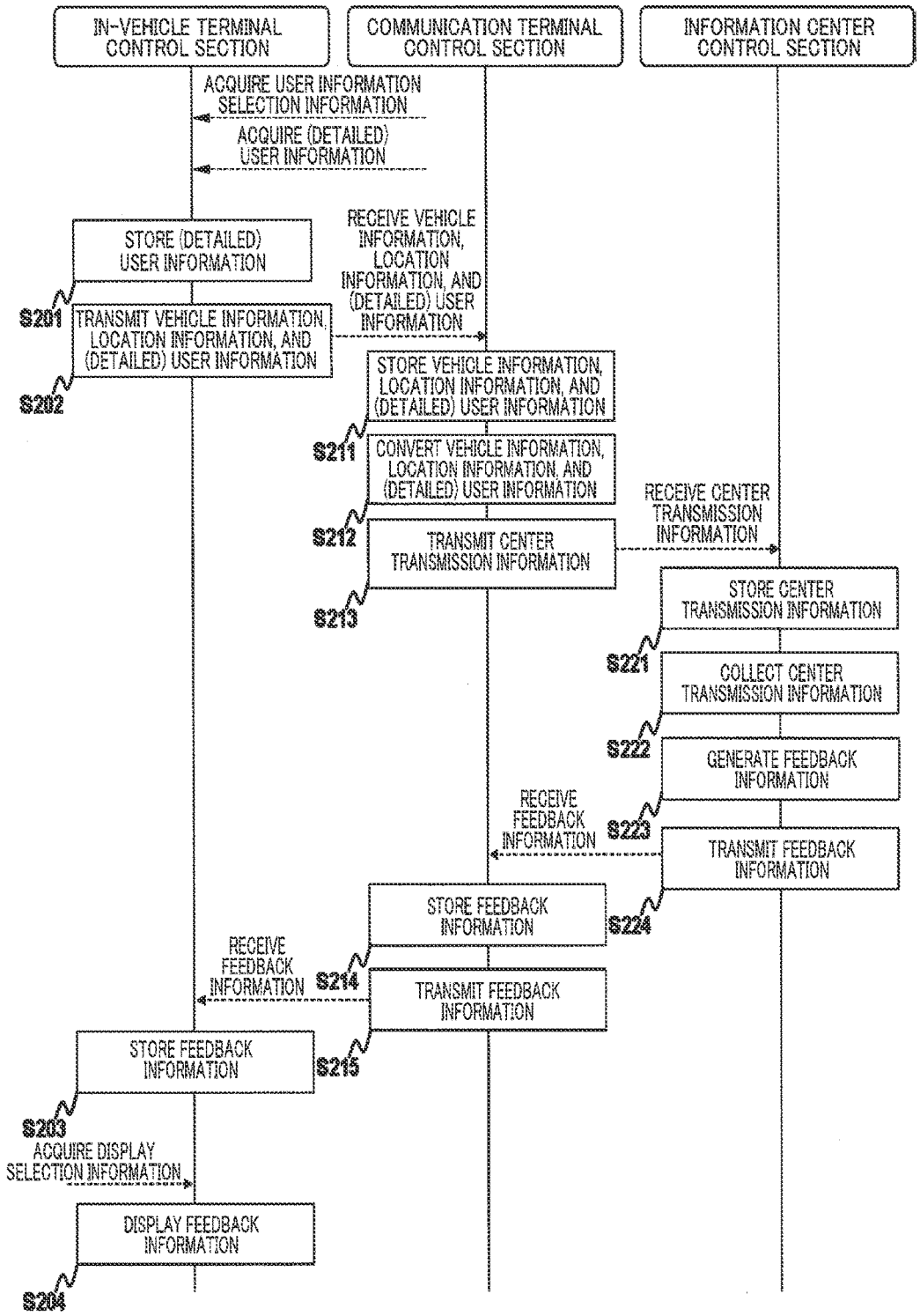
FIG. 3 is a flow chart for describing a transmission of detailed user information D3, and a reception of feedback information D5 in information system 100 in Embodiment 1 of the present invention.

FIG. 3 is a flow chart of a transmission of detailed user information D3, and a reception of feedback information D5 in information system 100 in Embodiment 1 of the present invention.

As illustrated in FIG. 3, upon acquiring user information selection information D6 and detailed user information D3, control section 112 of in-vehicle terminal device 110 stores the information in the RAM area (step S201), and transmits the information to control section 121 of communication terminal device 120 (step S202).

Upon receiving vehicle information D1, location information D2 and detailed user information D3, control section 121 of communication terminal device 120 stores the information in the RAM area (step S211), and converts the information into center transmission information D4 (step S212). Then, control section 121 establishes a communication between wireless communication section 122 of communication terminal device 120 and wireless communication section 132 of information center 130, to thereby transmit center transmission information D4 to control section 131 of information center 130 (step S213).

Upon receiving center transmission information D4, control section 131 of information center 130 stores the information in the RAM area (step S221), collects the information on the basis of center transmission information D4 transmitted from a plurality of vehicles (step S222), and generates feedback information D5 (step S223). Then, control section 131 establishes a communication between wireless communication section 132 of information center 130 and wireless communication section 122 of communication terminal device 120, to thereby transmit feedback information D5 to control section 121 of communication terminal device 120 (step S224).

Upon receiving feedback information D5 from information center 130, control section 121 of communication terminal device 120 stores the information in the RAM area (step S214), and transmits the information to control section 112 of in-vehicle terminal device 110 (step S215).

Upon receiving feedback information D5 from information center 130 through communication terminal device 120, control section 112 of in-vehicle terminal device 110 stores feedback information D5 in the RAM area in control section 112 of in-vehicle terminal device 110 (step S203). Then, in accordance with display selection information D7, control section 112 controls display section 111 to display the content representing feedback information D5 (step S204).

Next, the flows of the processing of control section 112 of in-vehicle terminal device 110, control section 121 of communication terminal device 120, and control section 131 of information center 130 illustrated in FIG. 2 and FIG. 3 are separately described in detail.

Figure 4:
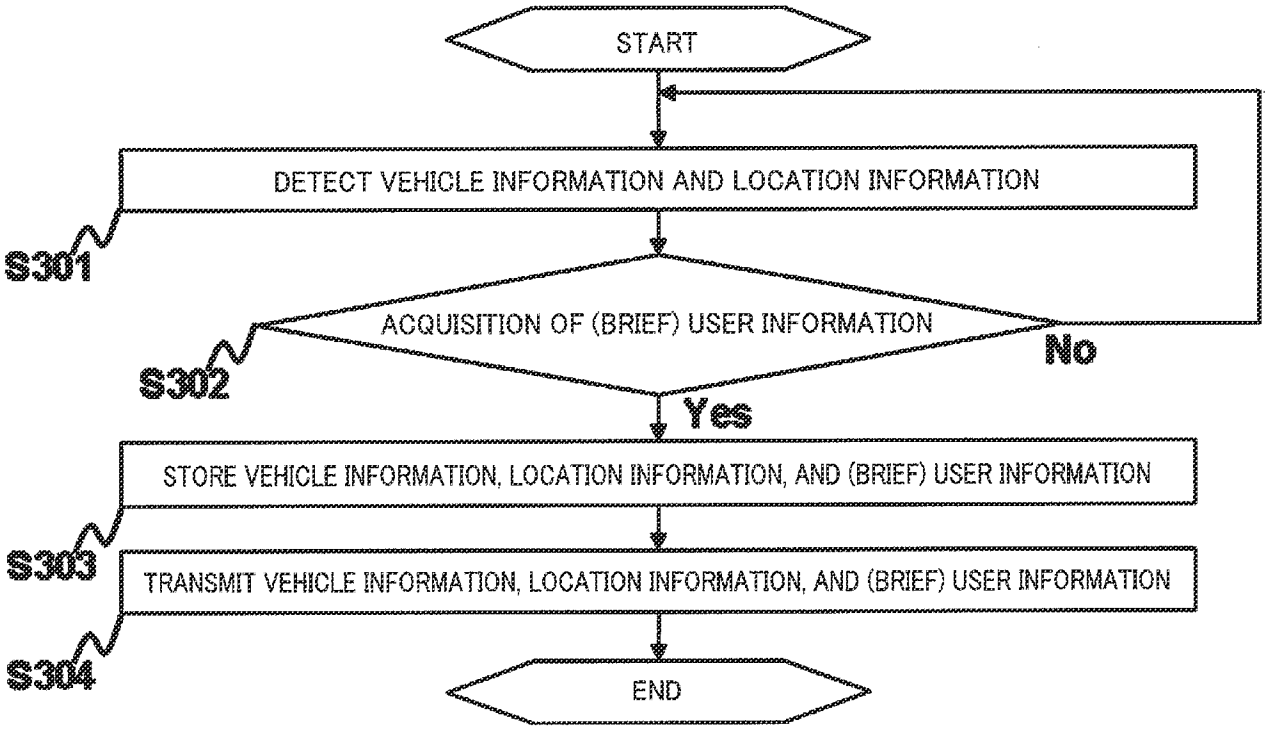
FIG. 4 is a flow chart for describing a transmission of brief user information D3 in in-vehicle terminal device 110 in Embodiment 1 of the present invention.
Figure 5:
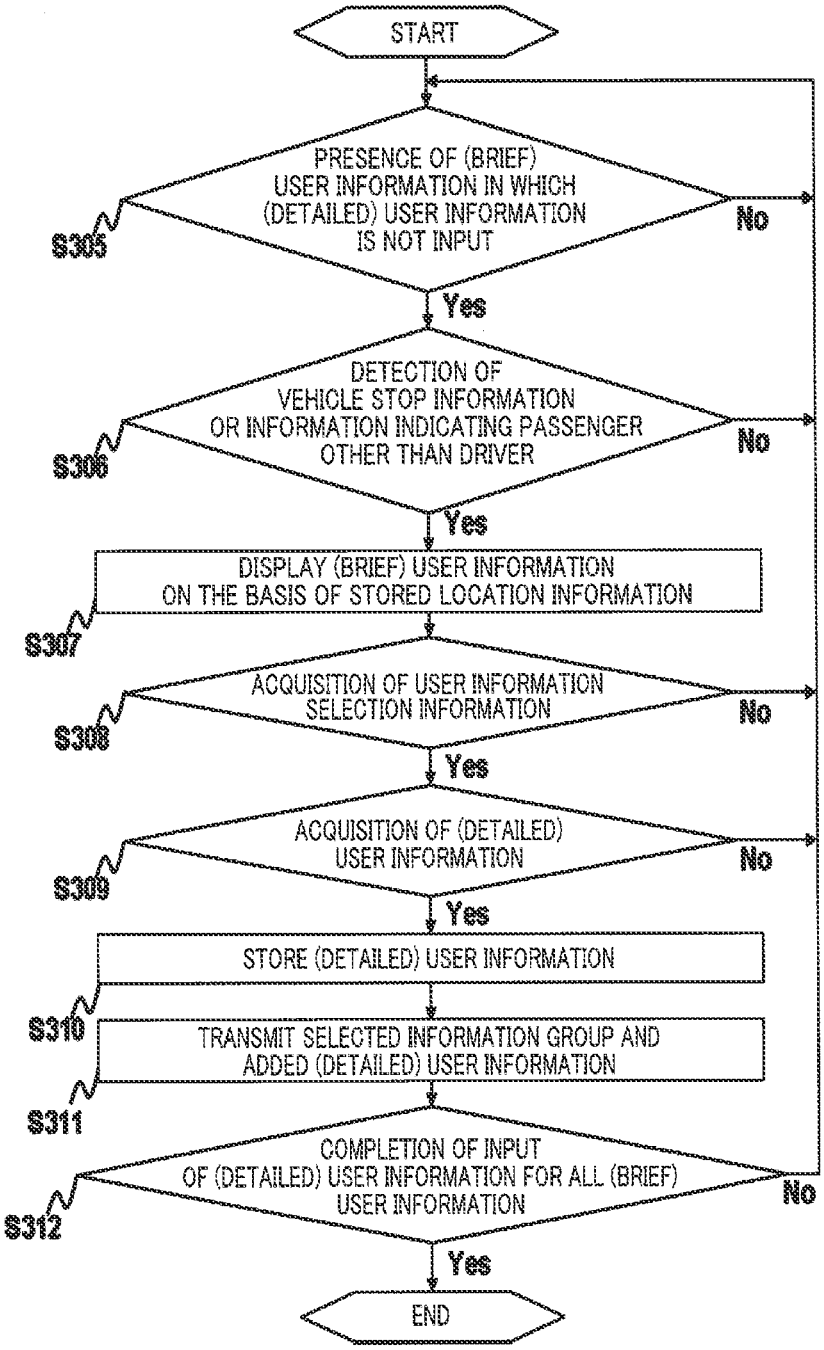
FIG. 5 is a flow chart for describing a transmission of detailed user information D3 in in-vehicle terminal device 110 in Embodiment 1 of the present invention.

FIG. 4 is a flow chart of a transmission of brief user information D3 executed by control section 112 of in-vehicle terminal device 110. FIG. 5 is a flow chart of a transmission of detailed user information D3 executed by control section 112 of in-vehicle terminal device 110.

The flow of FIG. 4 is now described. First, control section 112 detects vehicle information D1 and location information D2 (step S301), and determines whether brief user information D3 is input by the user as the passenger of the vehicle (step S302). It is to be noted that the processes of step S301 and step S302 may be reversed.

When the result of the determination process at step S302 is "Yes," in other words, when brief user information D3 input by the user has been acquired, the operation is performed as follows. Control section 112 stores detected vehicle information D1, location information D2, acquired brief user information D3, control section 112 in the RAM area (step S303), and transmits the information to control section 121 of communication terminal device 120 (step S304).

When the result of the determination process at step S302 is "No," in other words, brief user information D3 cannot be acquired, the process is returned to step S301, in other words, the process of detecting vehicle information D1 and location information D2.

The flow of FIG. 5 is now described. First, control section 112 determines whether brief user information D3 in which detailed user information D3 is not input is stored (step S305).

When the result of the determination process at step S305 is "Yes," in other words, when brief user information D3 is stored in RAM area of control section 112 of in-vehicle terminal device 110, the operation is performed as follows. Control section 112 determines whether information indicating that the vehicle is stopped is detected from the vehicle speed information in vehicle information D1, or determines whether a vehicle passenger other than the driver is detected on the basis of information from the seating sensor in vehicle information D1 (step S306).

When the result at step S306 is "Yes," in other words, when information indicating that the vehicle is stopped is detected from the vehicle speed information, or when a vehicle passenger other than the driver is detected by the seating sensor, the operation is performed as follows. On the basis of location information D2 stored in the RAM area of control section 112 of in-vehicle terminal device 110, control section 112 displays brief user information D3 on display section 111 (step S307).

It should be noted that, when the result at step S305 or step S306 is "No," the process is returned to step S305.

When brief user information D3 is displayed at step S307, the user as a vehicle passenger can perform an input operation by utilizing user interface section 113.

Here, when the user performs the input operation, control section 112 determines whether user information selection information D6 is acquired or not (step S308), and determines whether detailed user information D3 input by the user as a vehicle passenger can be acquired (step S309).

When it is determined that user information selection information D6 cannot be acquired at step S308 (No at step S308), or when it is determined that detailed user information D3 cannot be acquired at step S309 (No at step S309), the process is returned to step S305.

When it is determined that user information selection information D6 is acquired at step S308 (Yes at step S308), and that detailed user information D3 can be acquired at step S309 (Yes at step S309), the operation is performed as follows. Control section 112 acquires detailed user information D3, stores detailed user information D3 thus acquired in the RAM area of control section 112 (step S310), and transmits the information to control section 121 of communication terminal device 120 (step S311).

Then, control section 112 determines whether the user has completed the input of detailed user information D3 for all brief user information D3 (step S312).

When detailed user information D3 has not been acquired for brief user information D3 stored in the RAM area of control section 121 (No at step S312), the process is returned to step S305, in other words, the process of determining whether brief user information D3 is stored.

It should be noted that, when the result in step 312 is "No," it can be said that brief user information D3 is stored. Therefore, the process may be returned to step S306 when the results at step S312 is "No." That is, the process may be returned to the process of detecting information indicating that the vehicle is stopped from the vehicle speed information in vehicle information D1, or the process of detecting a vehicle passenger other than the driver on the basis of information from the seating sensor in vehicle information D1.

When detailed user information D3 is acquired (Yes at step S312) for all brief user information D3 stored in the RAM area of control section 121, the process is terminated.

It is to be noted that the relationship between the flow chart of FIG. 4 illustrating transmission of brief user information D3 and the flow chart of FIG. 5 illustrating transmission of detailed user information D3 is that the process is advanced from the process of transmitting brief user information D3 to the process of transmitting detailed user information D3, in a predetermined case. Here, the "predetermined case" is a case where information indicating that the vehicle is stopped is detected from the vehicle speed information in vehicle information D1, or a case where a vehicle passenger other than the driver is detected from information from the seating sensor in vehicle information D1, when brief user information D3 is stored in the RAM area of control section 112 of in-vehicle terminal device 110.

It is to be noted that an interrupt may be adopted for transferring the process from the process of transmitting brief user information D3 to the process of transmitting detailed user information D3.

Figure 6:
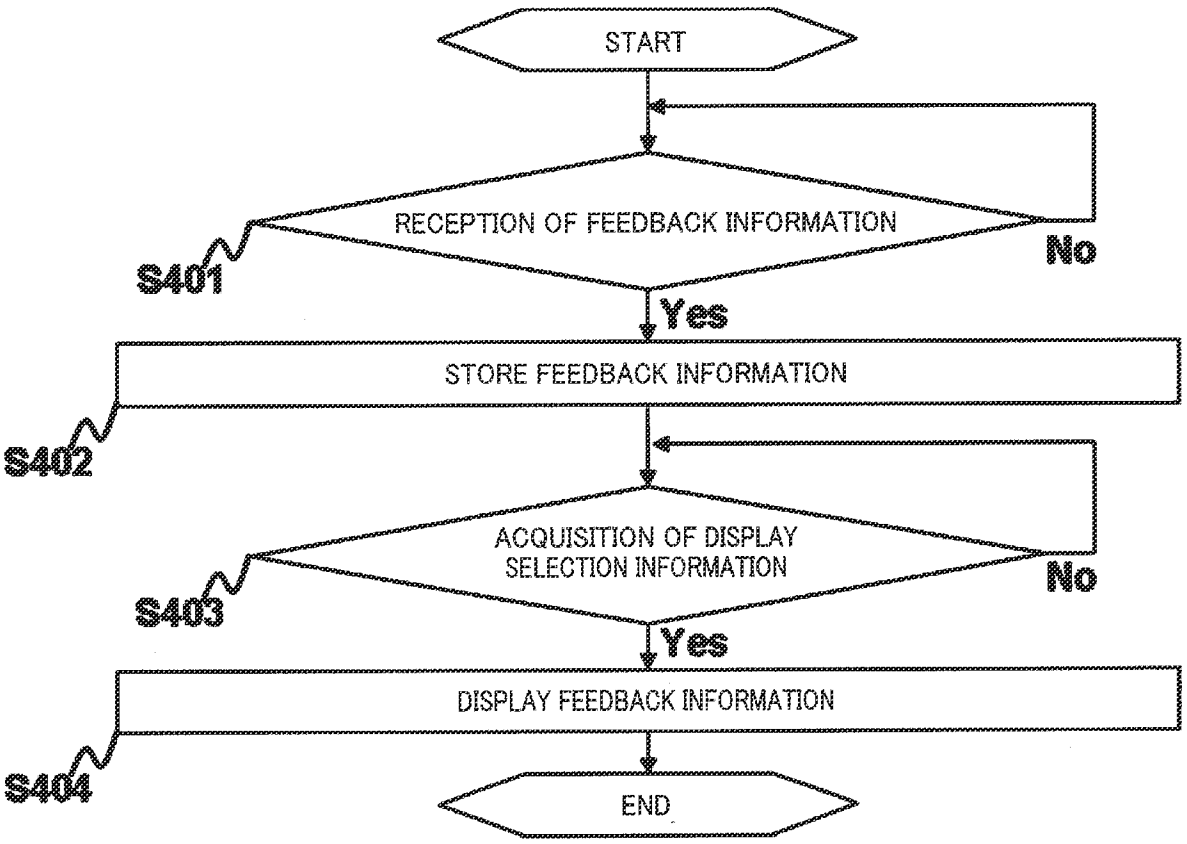
FIG. 6 is a flow chart for describing reception of feedback information D5 in in-vehicle terminal device 110 in Embodiment 1 of the present invention.

FIG. 6 is a flow chart of a reception of feedback information D5 of control section 112 of in-vehicle terminal device 110.

As illustrated in FIG. 6, control section 112 sequentially determines whether feedback information D5 has been received (step S401). Then, when feedback information D5 has been received (Yes at step S401), control section 112 stores the information in the RAM area of control section 112 of in-vehicle terminal device 110 (step S402).

Further, control section 112 determines whether display selection information D7 input by a vehicle passenger (user) has been acquired (step S403). Then, depending on whether display selection information D7 has been acquired, control section 112 determines whether to display feedback information D5 on display section 111.

Display selection information D7 in the present embodiment is information indicating the user's intention (intention to display information) input by the user about whether to display received feedback information D5 and the like on display section 111.

Therefore, when it is determined at step S403 that display selection information D7 has been acquired (step S403), control section 112 displays feedback information D5 on display section 111 (step S404), and terminates the process.

On the other hand, when it is determined at step S402 that display selection information D7 has not been acquired (No at step S403), control section 112 does not display feedback information D5 on display section 111. Then, the process is returned to step S403. That is, the process is returned to the process of determining whether to display feedback information D5 on the basis of the display selection information input by the vehicle passenger (user).

Figure 7:
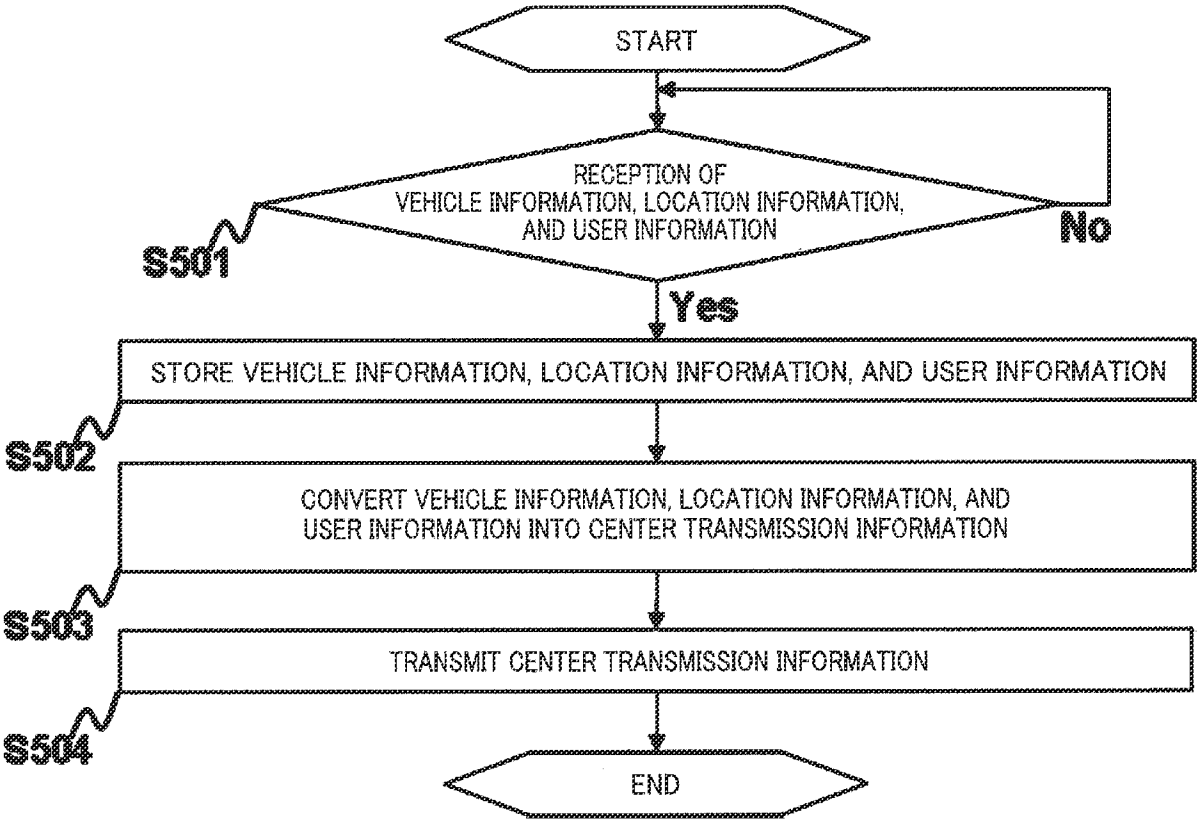
FIG. 7 is a flow chart for describing a transmission of center transmission information D4 in communication terminal device 120 in Embodiment 1 of the present invention.
Figure 8:
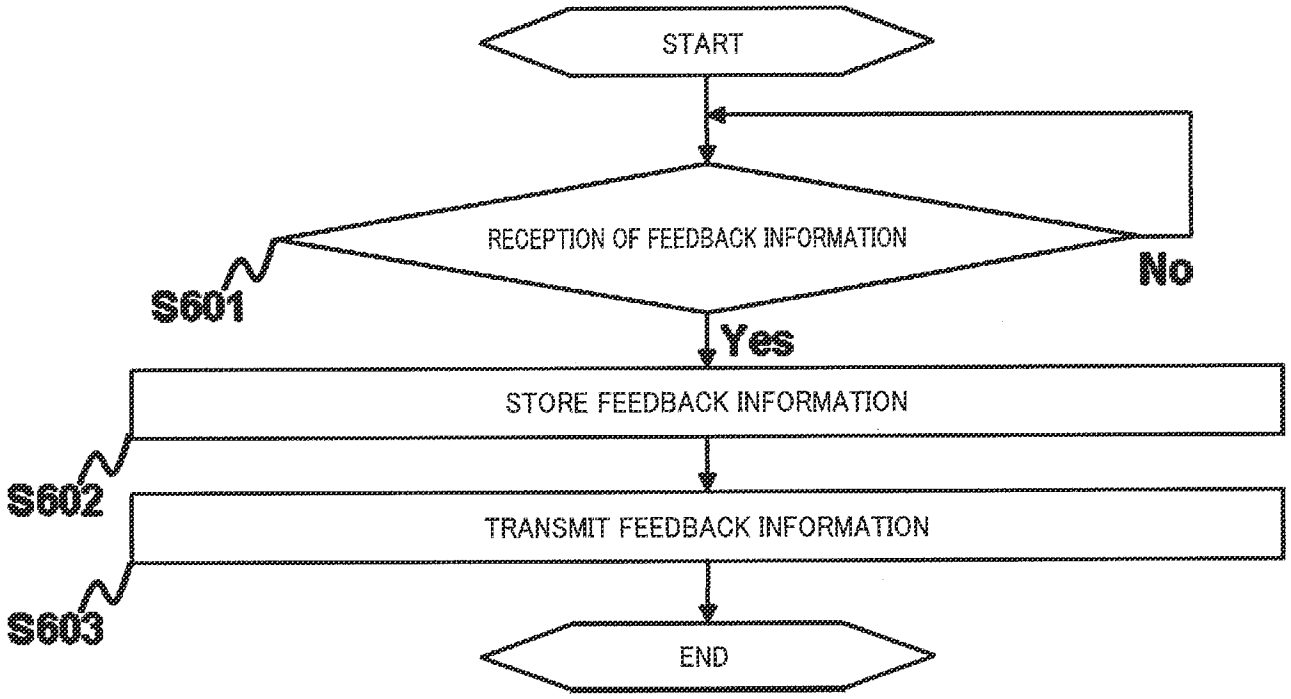
FIG. 8 is a flow chart for describing reception of feedback information D5 in communication terminal device 120 in Embodiment 1 of the present invention.

Next, with reference to FIG. 7 and FIG. 8, the process of communication terminal device 120 is described. FIG. 7 is a flow chart of a transmission of center transmission information D4 in control section 121 of communication terminal device 120.

As illustrated in FIG. 7, control section 121 of communication terminal device 120 sequentially determines whether vehicle information D1, location information D2, and user information D3 are received from control section 112 of in-vehicle terminal device 110 (step S501).

When it is determined at step S501 that the pieces of information (D1 to D3) have been received from control section 112 of in-vehicle terminal device 110 (Yes at step S501), control section 121 stores the pieces of information (D1 to D3) in its RAM area (step S502), and converts vehicle information D1, location information D2, and user information D3 into center transmission information D4 (step S503). Then, through wireless communication section 122 of communication terminal device 120, control section 121 transmits center transmission information D4 to information center 130 (step S504), and terminates the process. It is to be noted that, when it is not determined at step S501 that the pieces of information (D1 to D3) have been received (No at step S501), control section 121 again performs the determination of step S501.

FIG. 8 illustrates a flow chart of a reception of feedback information D5 in control section 121 of communication terminal device 120.

As illustrated in FIG. 8, control section 121 of communication terminal device 120 sequentially determines whether feedback information D5 has been received from information center 130 (step S601).

Under the control of control section 131 of information center 130, feedback information D5 is transmitted through wireless communication section 132 of information center 130. Upon receiving feedback information D5 through wireless communication section 122 (Yes at step S601), control section 121 stores the information in its RAM area (step S602). Then, control section 121 transmits feedback information D5 to control section 112 of in-vehicle terminal device 110 (step S603), and terminates the process. It is to be noted that, when no feedback information D5 has been received (No at step S601), control section 121 waits for the reception of feedback information D5.

Figure 9:
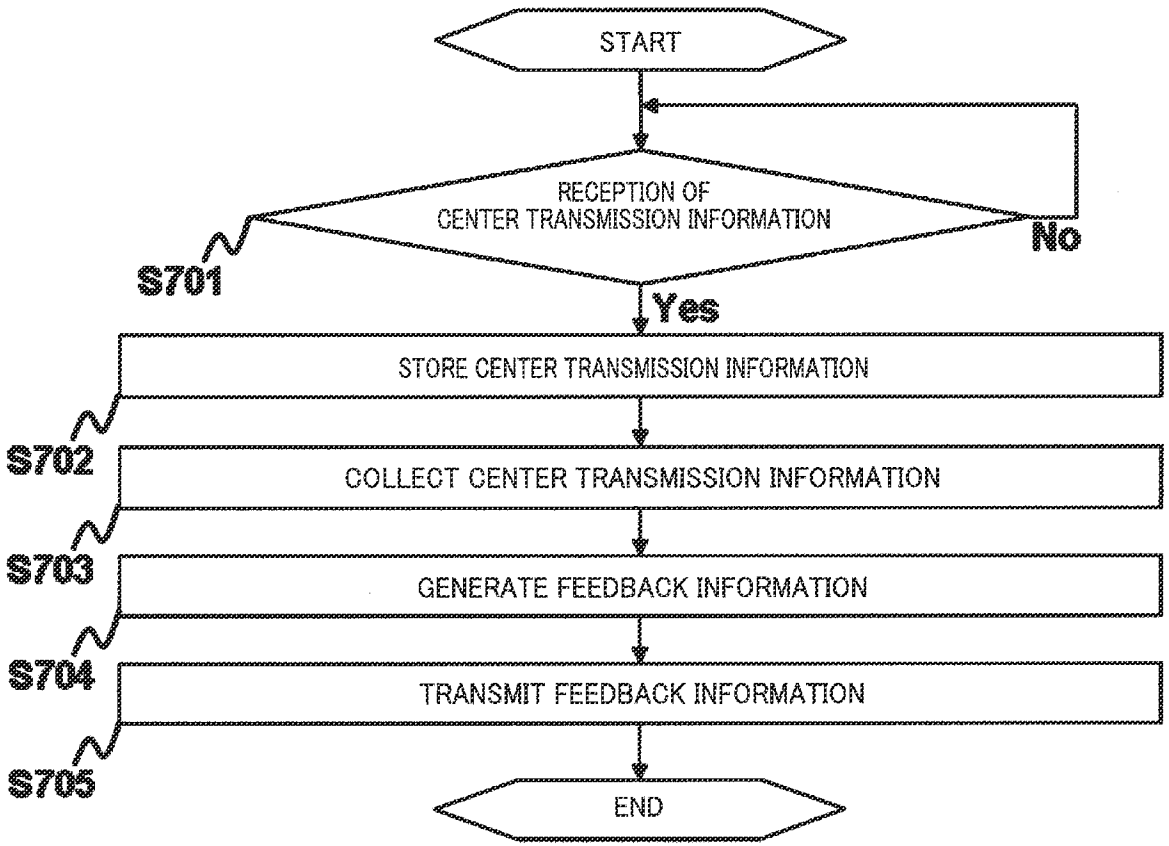
FIG. 9 is a flow chart for describing an operation of an information communication in information center 130 in Embodiment 1 of the present invention.

Next, with reference to FIG. 9, the process executed by control section 131 of information center 130 is described. FIG. 9 is a flow chart of a reception of center transmission information D4, and a transmission of feedback information D5 in control section 131 of information center 130.

As illustrated in FIG. 9, control section 131 of information center 130 sequentially determines whether center transmission information D4 has been received from communication terminal device 120 (step S701).

Under the control of control section 121 of communication terminal device 120, center transmission information D4 is transmitted through wireless communication section 122 of communication terminal device 120. Upon receiving center transmission information D4 through wireless communication section 132 (Yes at step S701), control section 131 stores the information in its RAM area (step S702). It is to be noted that, when no center transmission information D4 has been received (No at step S701), control section 121 waits for the reception of center transmission information D4.

Control section 131 collects center transmission information D4 received from a plurality of vehicles and stored therein (step S703), and generates feedback information D5 (step S704). Then, control section 131 transmits feedback information D5 to control section 121 of communication terminal device 120 through wireless communication section 132 (step S705), and terminates the process.

The following description explains a method for inputting user information D3 for the acquisition of (brief) user information D3 illustrated in FIG. 4 or FIG. 5 (step S302) and the acquisition of (detailed) user information D3 (step S309) in information system 100 that performs the process in the above-mentioned manner.

FIGS. 10 to 13 are schematic views illustrating a method for inputting brief user information D3. FIGS. 10 to 13 schematically illustrate the user interface section 113 whose state is changed (in two stages, in the example illustrated in FIGS. 10 to 13) in accordance with the speed of the vehicle in which in-vehicle terminal device 110 and communication terminal device 120 are mounted.

FIGS. 10 to 13 illustrate an example in which a reference speed of the vehicle speed is set, and the state of user interface section 113 is changed from one to the other depending on whether the speed is high or low with respect to the reference speed.

In the example illustrated in FIG. 10, buttons provided on the steering device are utilized as user interface section 113, and a method in which light of the buttons as a notification section is turned on, blinked, or turned off is adopted (details are described later). This allows the user to input brief user information D3.

Figure 10:
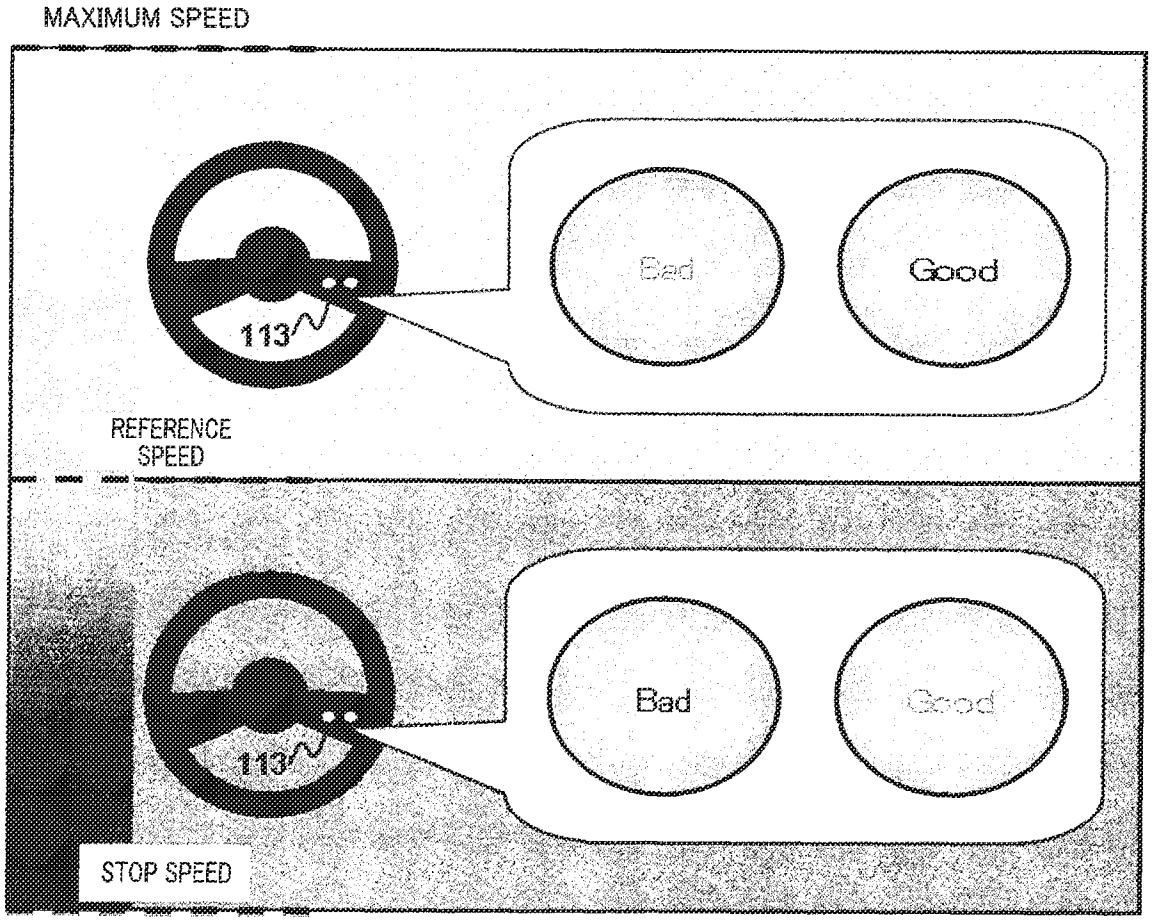
FIG. 10 is a schematic view for describing a first example of input of brief user information D3 in Embodiment 1 of the present invention.

Further, in the example illustrated in FIG. 10, for example, a reference speed is set, and when the speed is equal to or greater than the reference speed, a button indicating "Good" is lighted or blinked for example, or a button indicating "Bad" is turned off, for example. When the speed is equal to or lower than the reference speed, for example a button indicating "Bad" is lighted or blinked, for example, or a button indicating "Good" is turned off, for example. By assisting the user to press the buttons in this manner, brief input of information by the user is achieved.

Specifically, when the vehicle is travelling at a speed higher than the reference speed set in advance, it can be estimated that the road is not crowded and that the vehicle is comfortably travelling, and therefore the evaluation (impression, opinion, etc.) of the user can be estimated as "good." Therefore, in-vehicle terminal device 110 is set in advance in such a manner as to facilitate the user to press the "Good" button provided on the steering device.

When the vehicle is travelling at a speed lower than the reference speed set in advance (or when the vehicle is stopped), it can be estimated that the road is crowded, and therefore the evaluation (impression, opinion, etc.) of the user can be estimated as "not good." Therefore, in-vehicle terminal device 110 is set in advance in such a manner as to facilitate the user to press the "Bad" button provided on the steering device.

Figure 11:
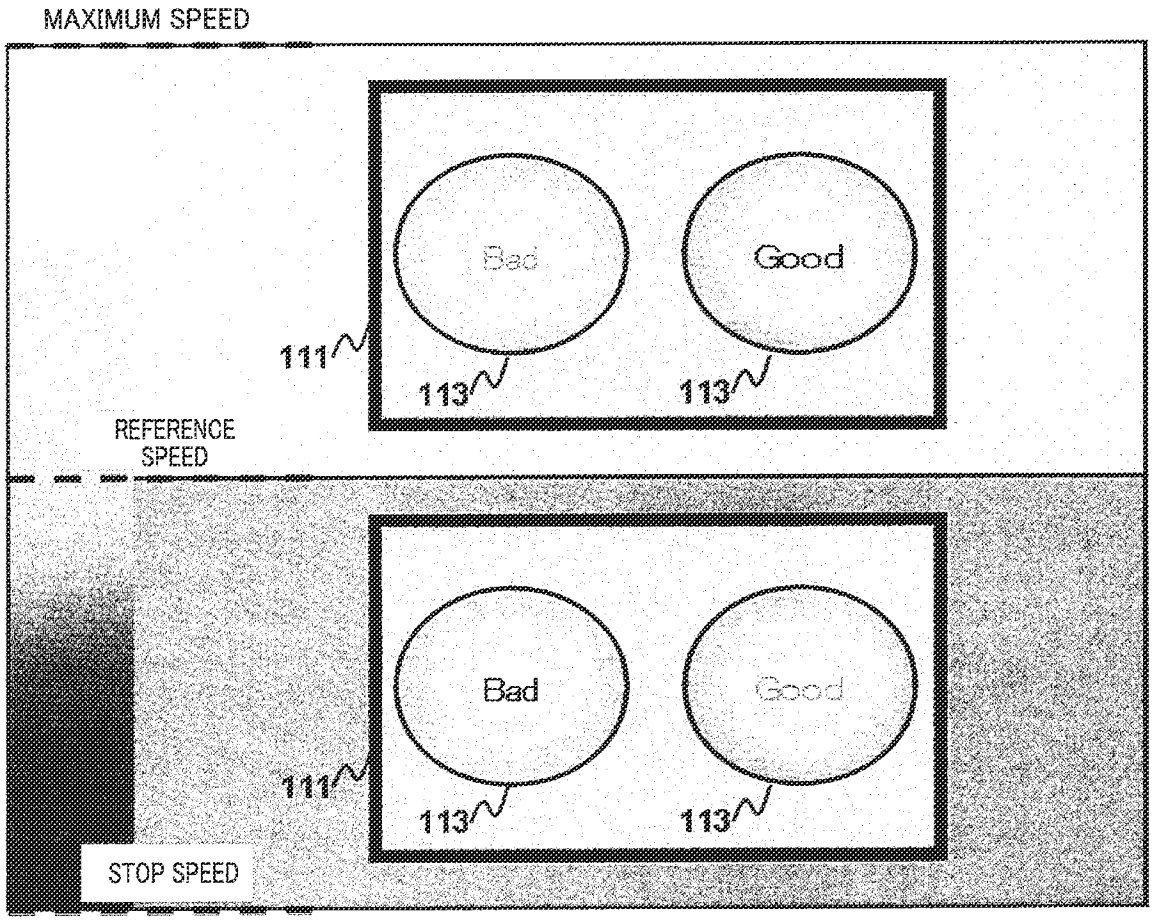
FIG. 11 is a schematic view for describing a second example of input of brief user information D3 in Embodiment 1 of the present invention.
Figure 12:
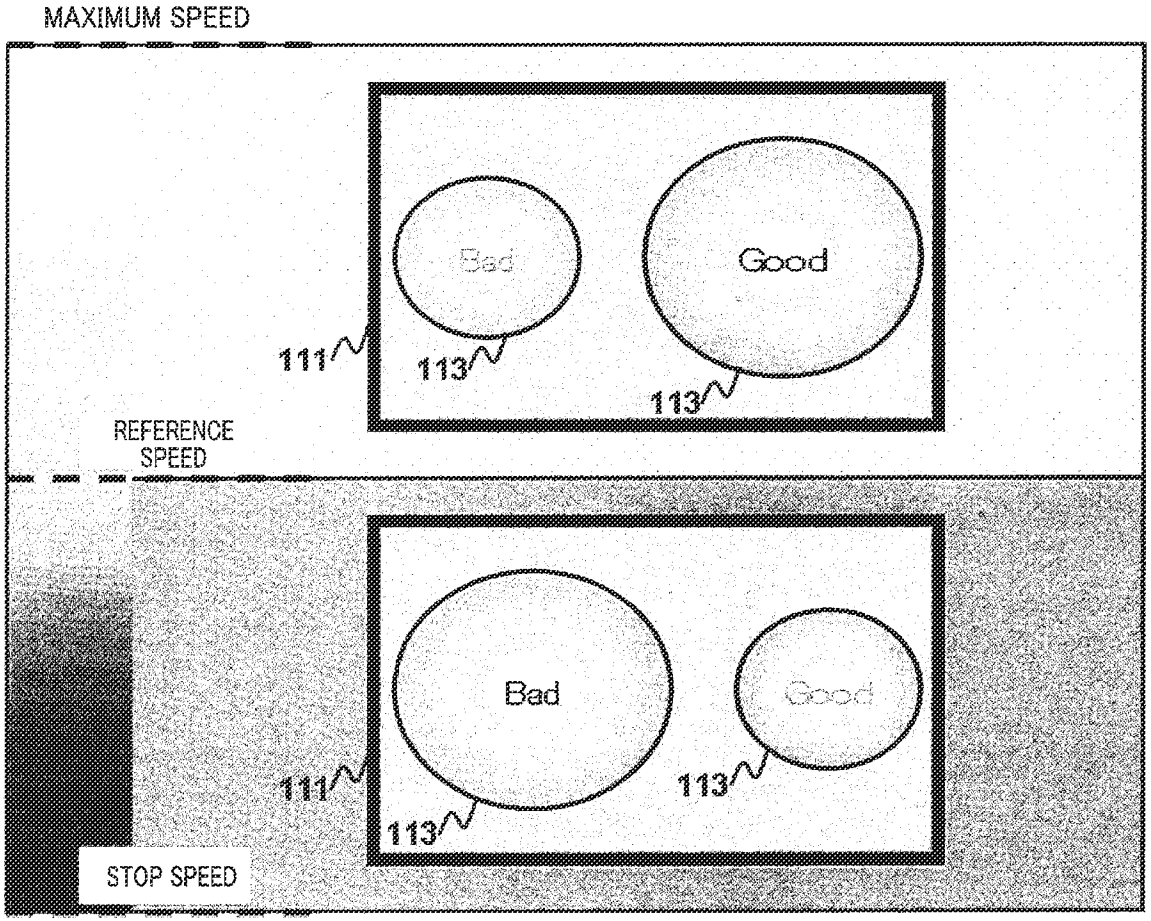
FIG. 12 is a schematic view for describing a third example of input of brief user information D3 in Embodiment 1 of the present invention.

In the example illustrated in FIG. 11 and FIG. 12, a touch panel is utilized as user interface section 113, and buttons displayed on a display as display section 111 are utilized. This allows the user to input brief user information D3.

In this example, for example, a reference speed is set, and when the speed is greater than the reference speed, for example, a button indicating "Good" is lighted or blinked or the size of the button to be displayed is relatively increased. When the speed is lower than the reference speed, for example, a button indicating "Bad" is lighted or blinked or the size of the button to be displayed is increased. By assisting the user to press the buttons in this manner, smooth input of brief user information by the user can be achieved.

Specifically, when the vehicle is travelling at a speed higher than the reference speed set in advance, it can be estimated that the road is not crowded and that the vehicle is comfortably travelling, and therefore the evaluation (impression, opinion, etc.) of the user can be estimated as "good." Therefore, in-vehicle terminal device 110 is set in advance in such a manner as to facilitate the user to press the "Good" button displayed on the screen (light or blink the buttons, or increase the size of the buttons).

When the vehicle is travelling at a speed lower than the reference speed set in advance (or when the vehicle is stopped), it can be estimated that the road is crowded, and therefore the evaluation (impression, opinion, etc.) of the user can be estimated as "not good." Therefore, in-vehicle terminal device 110 is set in advance in such a manner as to facilitate the user to press the "Bad" button displayed on the screen.

It is to be noted that, while the buttons for the input operation by the user described above are the buttons provided on the steering device or the buttons displayed on the screen, the buttons may be disposed in other places, and other switches may alternatively be used.

Figure 13:
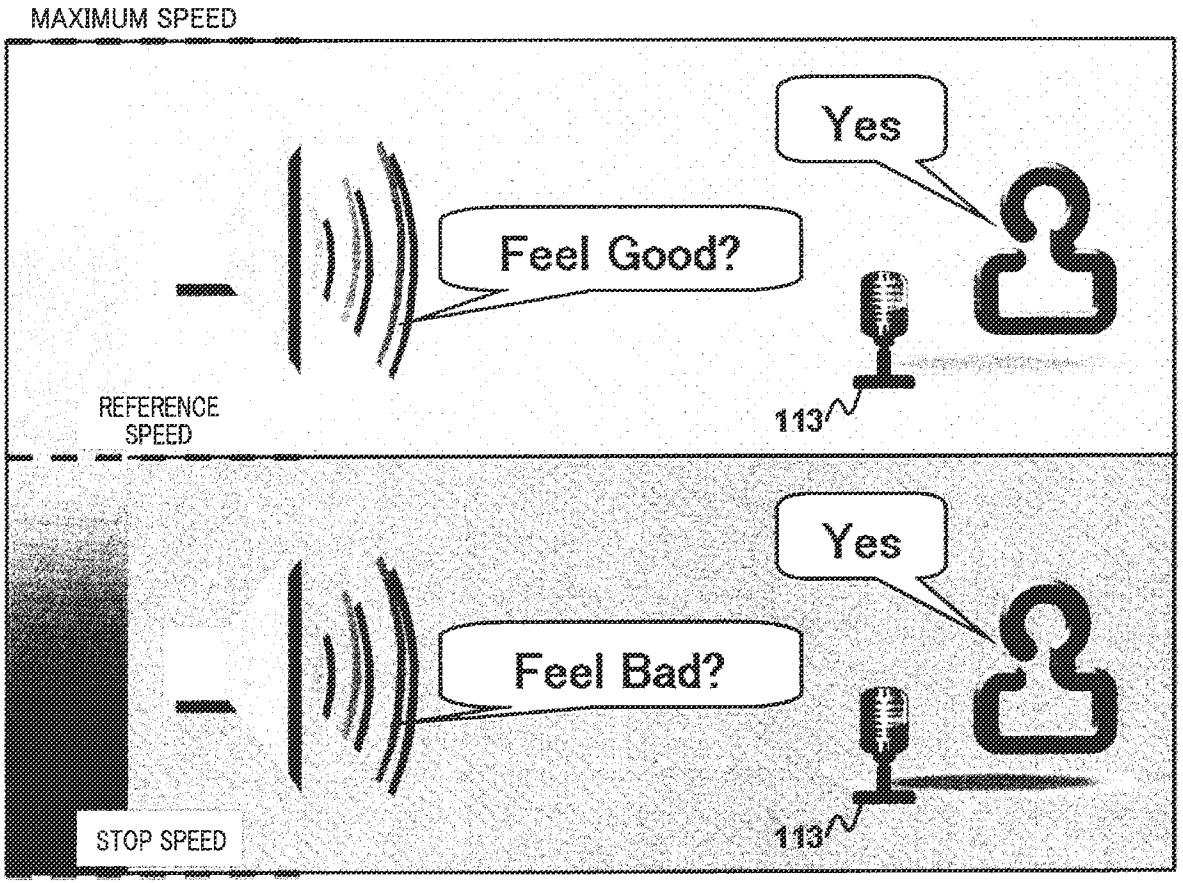
FIG. 13 is a schematic view for describing a fourth example of input of brief user information D3 in Embodiment 1 of the present invention.

In the example illustrated in FIG. 13, a microphone is utilized as user interface section 113, and an in-vehicle speaker is utilized as the notification section in place of display section 111. This allows the user to input brief user information D3.

In this case, for example, a reference speed is set, and the question, for example, "Feel Good" is asked through the in-vehicle speaker when the speed is greater than the reference speed, and the user's answer is detected through in-vehicle microphone. When the speed is lower than the reference speed, for example, the question "FeelBad" is asked through the in-vehicle speaker, and the user's answer is detected through the in-vehicle microphone. By assisting the user to answer in this manner, smooth input of brief user information by the user can be achieved.

Specifically, when the vehicle is travelling at a speed higher than the reference speed set in advance, it can be estimated that the road is not crowded and that the vehicle is comfortably travelling, and therefore the evaluation (impression, opinion, etc.) of the user can be estimated as "good." Therefore, the question output through the in-vehicle speaker is "FeelGood," and vehicle terminal device 110 is set in advance in such a manner as to facilitate the user to return an answer representing "Good."

When the vehicle is travelling at a speed lower than the reference speed set in advance (or when the vehicle is stopped), it can be estimated that the road is crowded, and therefore the evaluation (impression, opinion, etc.) of the user can be estimated as "not good." Therefore, the question output through the in-vehicle speaker is "FeelBad," and vehicle terminal device 110 is set in advance in such a manner as to facilitate the user to return an answer representing "Bad."

It is to be noted that a plurality of reference speeds may be set, and the state of user interface section 113 may be set to any of three or more states in accordance with the reference speeds.

Figure 14:
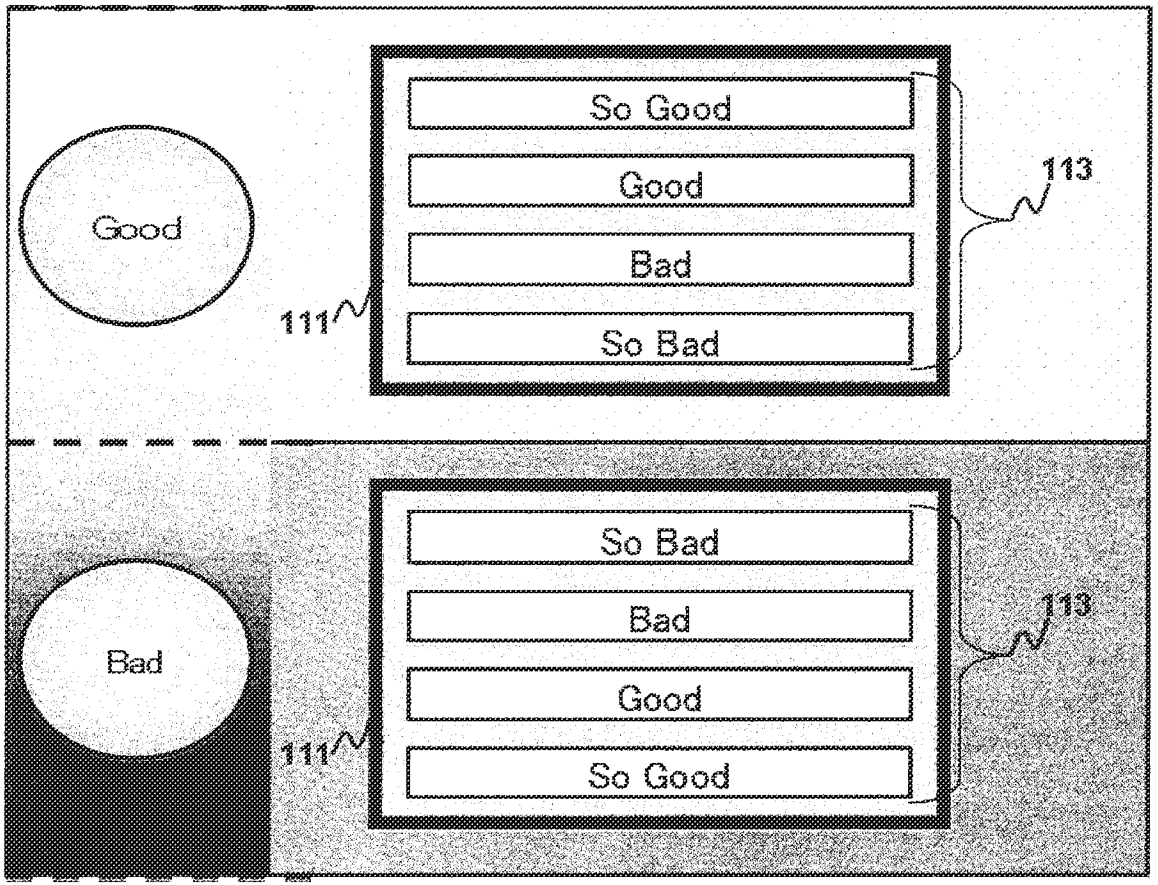
FIG. 14 is a schematic view for describing a first example of input of detailed user information D3 in Embodiment 1 of the present invention.
Figure 15:
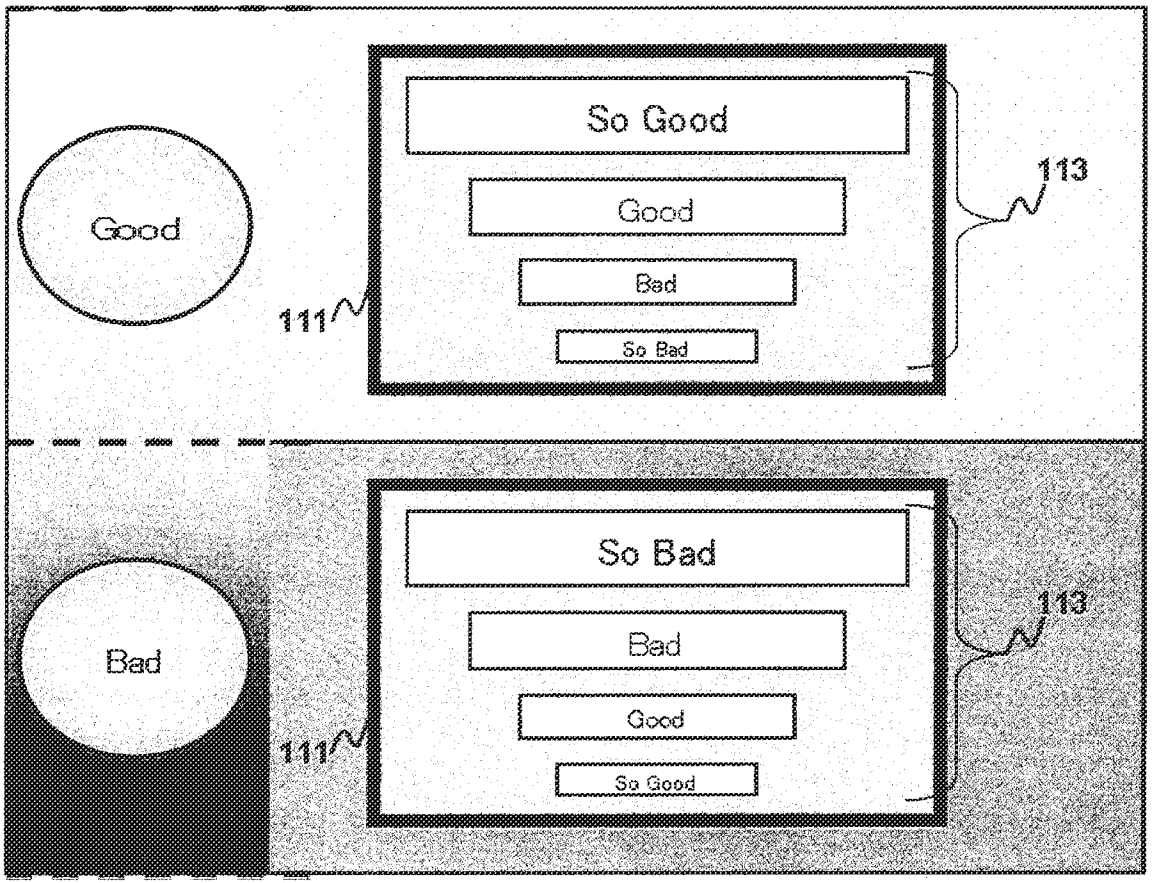
FIG. 15 is a schematic view for describing a second example of input of detailed user information D3 in Embodiment 1 of the present invention.
Figure 16:
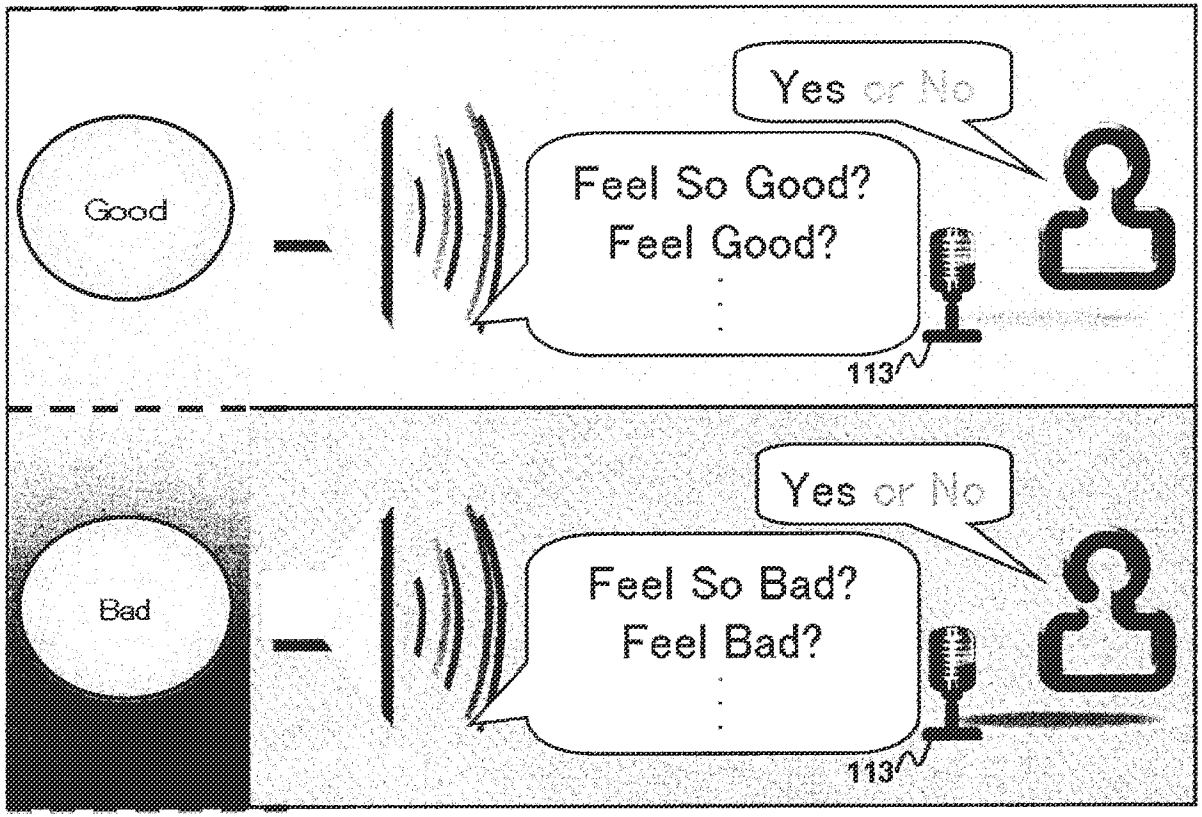
FIG. 16 is a schematic view for describing a third example of input of detailed user information D3 in Embodiment 1 of the present invention.

Next, with reference to FIG. 14 to FIG. 16, the operation performed at the time of inputting detailed user information D3 is described. FIGS. 14 to 16 are schematic views illustrating a method for inputting detailed user information D3. FIGS. 14 to 16 schematically illustrate the state where the content displayed on display section 111 (content to be notified) changes in accordance with previously input brief user information D3 (in the example illustrated in FIGS. 14 to 16, two types of brief user information D3).

FIGS. 14 to 16 illustrate an exemplary case where the state of user interface section 113 is changed one to the other in accordance with previously input brief user information D3.

In the example illustrated in FIG. 14, buttons and a touch panel indicating fixed phrases on a screen are used as display section 111 and user interface section 113. This allows for input of detailed user information D3.

Further, in the case where previously input brief user information D3 is "Good," buttons indicating fixed phrases "SoGood," "Good," "Bad," and "SoBad" are displayed in this order from the upside of the display, for example.

In the case where previously input brief user information D3 is "Bad," buttons indicating fixed phrases "SoBad," "Bad," "Good," "SoGood" are displayed in this order from the upside of the display, for example. By assisting the user to press the buttons in this manner, input of detailed user information D3 by the user is facilitated.

Specifically, when previously input brief user information D3 is "Good," it can be estimated that the road is not crowded and that the vehicle is comfortably travelling, and therefore the evaluation (impression, opinion, etc.) of the user can be estimated as "good." Therefore, in-vehicle terminal device 110 is set in advance in such a manner as to facilitate the user to press the button indicating a fixed phrase "SoGood," and the button indicating a fixed phrase "Good" in this order.

When previously input brief user information D3 is "Bad," it can be estimated that the traveling road is crowded, and therefore the evaluation (impression, opinion, etc.) of the user can be estimated as "not good." Therefore, in-vehicle terminal device 110 is set in advance in such a manner as to facilitate the user to press the button indicating a fixed phrase "SoBad," and the button indicating a fixed phrase "Bad" in this order.

In the example illustrated in FIG. 15, in a display as display section 111, buttons in which the sizes of fixed phrases are changed are utilized. This allows for input of detailed user information D3 (also in this case, a touch panel is used as user interface section 113).

Further, when previously input brief user information D3 is "Good," the buttons indicating fixed phrases are displayed such that the sizes of the buttons are reduced in the order of "SoGood," "Good," "Bad," and "SoBad" from the upside of the display, for example.

When previously input brief user information D3 is "Bad," the buttons indicating fixed phrases are displayed such that the sizes of the buttons are reduced in the order of "SoBad," "Bad," "Good," and "SoGood" from the upside of the display, for example. By assisting the user to press the buttons in this manner, smooth input of detailed user information D3 by the user can be achieved.

Specifically, when previously input brief user information D3 is "Good," it can be estimated that the road is not crowded and that the vehicle is comfortably travelling, and therefore the evaluation (impression, opinion, etc.) of the user can be estimated as "good." Therefore, in-vehicle terminal device 110 is set in advance in such a manner that the sizes of the fixed phrases indicating "SoGood" and "Good" displayed on the screen are changed so as to facilitate the user to press the buttons.

Then, when previously input brief user information D3 is "Bad," it can be estimated that the traveling road is crowded, and therefore the evaluation (impression, opinion, etc.) of the user can be estimated as "not good." Therefore, in-vehicle terminal device 110 is set in advance in such a manner that the sizes of the fixed phrases indicating "SoBad" and "Bad" displayed on the screen are changed so as to facilitate the user to press the buttons.

In the example illustrated in FIG. 16, a microphone is utilized as user interface section 113, and an in-vehicle speaker is utilized as the notification section. This allows for input of detailed user information D3.

Further, when previously input brief user information D3 is the answer for "FeelGood," the questions "FeelSoGood," "FeelGood," "FeelBad," and "FeelSoBad" are asked in this order through the in-vehicle speaker, for example, and the user's answer is detected through the in-vehicle microphone.

When previously input brief user information D3 is the answer for "FeelBad," the questions "FeelSoBad," "FeelBad," "FeelGood," and "FeelSoGood" are asked in this order through the in-vehicle speaker, for example, and the user's answer is detected through the in-vehicle microphone. By facilitating the user's answer in this manner, smooth input of detailed user information D3 by the user can be achieved.

Specifically, previously input brief user information D3 is the answer for "FeelGood," it can be estimated that the road is not crowded and that the vehicle is comfortably travelling, and therefore the evaluation (impression, opinion, etc.) of the user can be estimated as "good." Therefore, in-vehicle terminal device 110 is set in advance such that the questions "FeelSoGood" and "FeelGood" are output through the in-vehicle speaker in this order so as to facilitate the user to answer.

When previously input brief user information D3 is the answer for "FeelBad," it can be estimated that the traveling road is crowded, and therefore the evaluation (impression, opinion, etc.) of the user can be estimated as "not good." Therefore, in-vehicle terminal device 110 is set in advance such that the questions "FeelSoBad" and "FeelBad" are output through the in-vehicle speaker in this order so as to facilitate the user to answer.

It is to be noted that, while detailed user information D3 to be displayed is a fixed phrase in the above-mentioned example, any detailed user information D3 may be input by the user.

In addition, the fixed phrases may be displayed in the order obtained from the statistical result of information transmitted from the vehicles and collected in information center 130.

In the present embodiment, information system 100 transmits brief user information D3 to information center 130, and then transmits detailed user information D3 when stop information is detected or when a passenger other than the driver is detected, whereby information can be voluntarily transmitted from the vehicle side to information center 130 and a real time operation can be achieved.

Embodiment 2

Next, information system 200 in Embodiment 2 of the present invention will be described. It should be noted that, in the present embodiment, the configurations as those in Embodiment 1 will be denoted by the same reference numerals, and details of such configurations will be omitted. First, display information D8 used in the following description is described.

Display information D8 is information generated by communication terminal device 220, which is used for a display (notification) on display section (notification section) 111 so that the user selects brief user information D3 to which detailed user information D3 is input. It is to be noted that display information D8 includes at least location information D2 and brief user information D3.

It is also possible to adopt a configuration in which location information D2 is transmitted to in-vehicle terminal device 210, and display information D8 is generated in in-vehicle terminal device 210.

Figure 17:
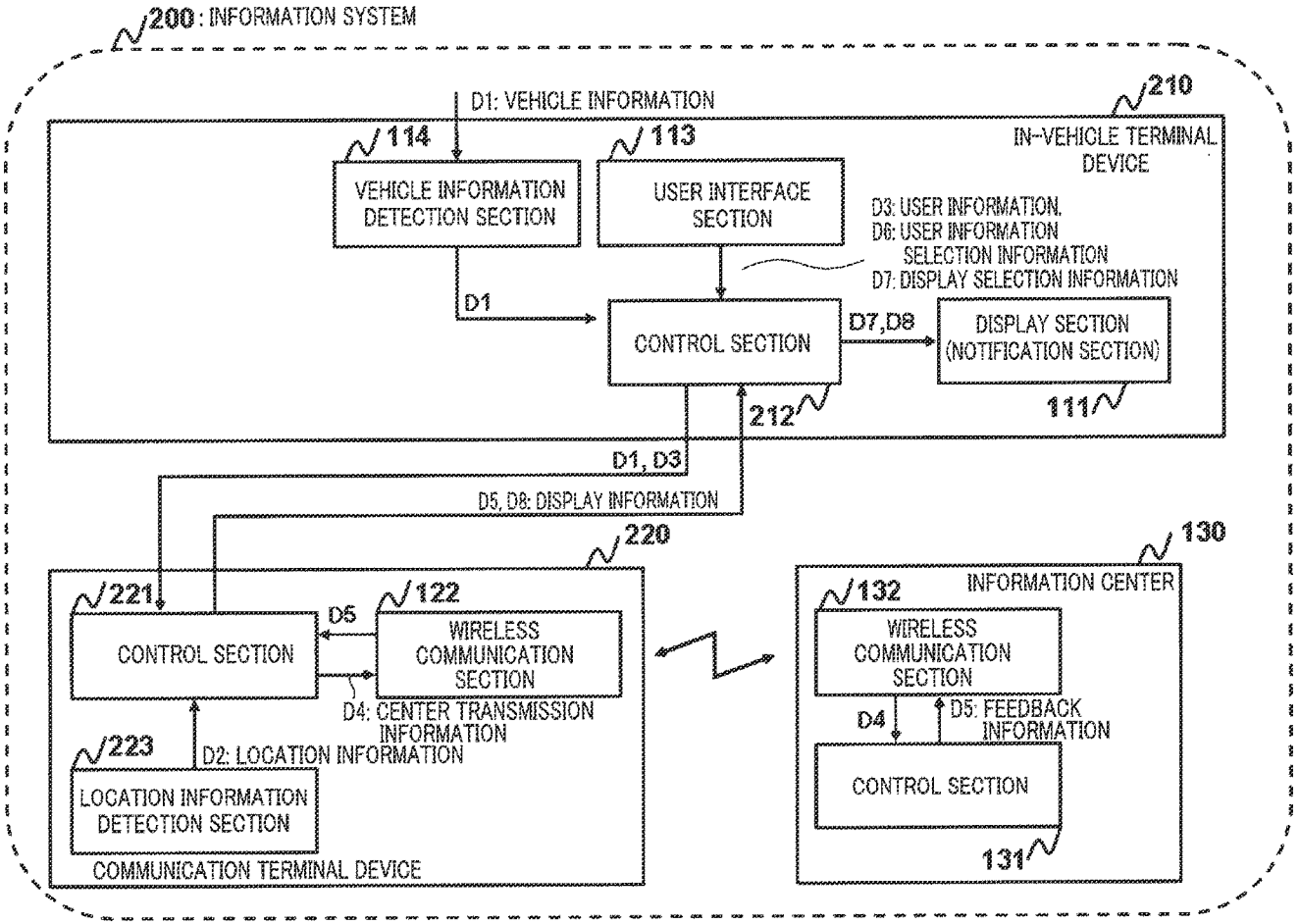
FIG. 17 is a configuration diagram of information system 200 in Embodiment 2 of the present invention.

Next, information system 200 in Embodiment 2 of the present invention is described with reference to the drawings. FIG. 17 illustrates the configuration diagram of information system 200 in Embodiment 2 of the present invention.

In FIG. 17, information system 200 includes in-vehicle terminal device 210, communication terminal device 220, and information center 130. In-vehicle terminal device 210 is provided with a function of detecting vehicle information D1; a function of acquiring, displaying and inputting user information D3; a function of acquiring user information selection information D6; a function of acquiring display selection information D7; and a function of acquiring and displaying display information D8. Communication terminal device 220 transmits information (D1, D3) from in-vehicle terminal device 210 and information (D2) from communication terminal device 220, or receives information (D5) from information center 130. Information center 130 is a device for reception of information from the vehicle (D4), collection of the received information, and transmission of the information to vehicles (D5).

It is to be noted that, in information center 130, as information is received from a plurality of the vehicles having in-vehicle terminal device 210 and communication terminal device 220, the amount of information collected in information center 130 is increased, thus improving the reliability of information. In this manner, as in Embodiment 1, the information transmitted from information center 130 can be used as useful information for the users who received the information from information center 130.

In-vehicle terminal device 210 and communication terminal device 220 are provided in a vehicle such as an automobile (or the vehicle interior).

In-vehicle terminal device 210 is configured to detect vehicle information D1, acquire and store user information D3 input by the user, and transmit the information to communication terminal device 220.

In addition, in-vehicle terminal device 210 is configured to display information D8 received from communication terminal device 220. In addition, in-vehicle terminal device 210 is configured to receive feedback information D5 received by communication terminal device 220 from information center 130, and display the information on the basis of display selection information D7. Here, in-vehicle terminal device 210 is an in-vehicle terminal device in which a display is mounted. For example, in-vehicle terminal device 210 is an in-vehicle device such as a display audio and a meter display.

In-vehicle terminal device 210 includes display section 111, control section 212, user interface section 113, and vehicle information detection section 114. Display section 111 is a display, and the like. Control section 212 is composed of a microcomputer, ROM and RAM as storage sections, and the like, for example. User interface section 113 is composed of a touch panel on the display, a remote controller, a steering switch or other switches. User interface section 113 acquires user information D3, user information selection information D6, and display selection information D7. Vehicle information detection section 114 detects vehicle information D1.

The microcomputer of control section 212 executes a computer program which is stored in the ROM and configured to perform a control process, by using the RAM as a work area. At this time, the microcomputer of control section 112 temporarily stores vehicle information D1, user information D3, and display information D8 in the RAM area, and temporarily stores feedback information D5 received from the communication terminal device.

Communication terminal device 220 receives user information D3 and vehicle information D1 from in-vehicle terminal device 210, and detects location information D2 at this time. Communication terminal device 220 converts the information into center transmission information D4 and display information D8, and transmits the information to information center 130 and in-vehicle terminal device 210.

In addition, Communication terminal device 220 receives feedback information D5 collected by information center 130. Here, as communication terminal device 220, a mobile phone, a smartphone or the like can be utilized, for example.

Communication terminal device 220 includes control section 221, wireless communication section 122, and location information detection section 223. Control section 221 is composed of a microcomputer, ROM and RAM as storage sections, and the like, for example. Under the instruction of control section 221, wireless communication section 122 transmits center transmission information D4, or receives feedback information D5 from information center 130. Location information detection section 223 detects location information D2.

The microcomputer of control section 221 executes a computer program which is stored in the ROM and configured to perform a control process, by using the RAM as a work area. At this time, the microcomputer of control section 221 temporarily stores information transmitted from in-vehicle terminal device 210 (D1 to D3), location information D2 detected by location information detection section 223, and information (D5) transmitted from information center 130, in the RAM area.

Next, the processing and operation of information system 200 having the above-mentioned configuration are described.

Figure 18:
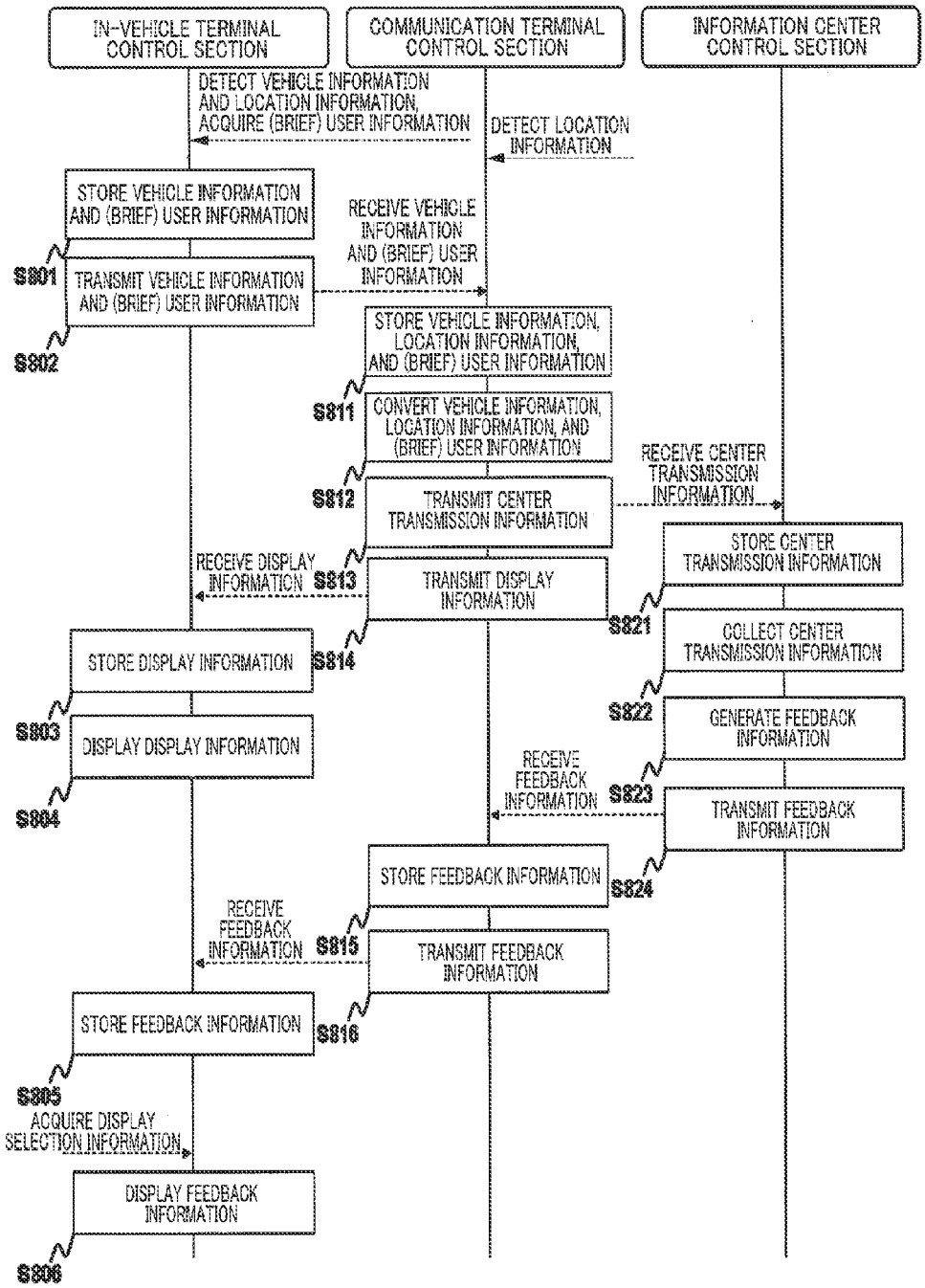
FIG. 18 is a flow chart for describing a transmission of brief user information D3, and a reception of feedback information D5 in information system 200 in Embodiment 2 of the present invention.

FIG. 18 is a flow chart of a transmission of brief user information D3 and a reception of feedback information D5 in information system 200 in Embodiment 2 of the present invention. First, with reference to FIG. 18, the flow of the whole process of information system 200 is described.

As illustrated in FIG. 18, upon detecting vehicle information D1 and acquiring brief user information D3, control section 212 of in-vehicle terminal device 210 stores the information in the RAM area (step S801), and transmits the information to control section 221 of communication terminal device 220 (step S802).

Upon detecting location information D2 and receiving vehicle information D1 and brief user information D3, control section 221 of communication terminal device 220 stores the information in the RAM area (step S811), and converts the information into center transmission information D4 and display information D8 (step S812). Then, control section 221 establishes a communication between wireless communication section 122 of communication terminal device 220 and wireless communication section 132 of information center 130, to thereby transmit center transmission information D4 to control section 131 of information center 130 (step S813). In addition, control section 221 transmits display information D8 to in-vehicle terminal device 210 (step S814).

Upon receiving display information D8, control section 212 of in-vehicle terminal device 210 stores the information in the RAM area (step S803), and displays the information on display section 111 of in-vehicle terminal device 210 (step S804).

Upon receiving center transmission information D4, control section 131 of information center 130 stores the information in the RAM area (step S821), collects the information on the basis of center transmission information D4 transmitted from a plurality of vehicles (step S822), and generates feedback information D5 (step S823). Then, control section 131 establishes a communication between wireless communication section 132 of information center 130 and wireless communication section 122 of communication terminal device 220, to thereby transmit feedback information D5 to control section 221 of communication terminal device 220 (step S824).

Upon receiving feedback information D5 from information center 130, control section 221 of communication terminal device 220 stores the information in the RAM area (step S815), and transmits the information to control section 212 of in-vehicle terminal device 210 (step S816).

Upon receiving feedback information D5 from information center 130 through communication terminal device 220, control section 212 of in-vehicle terminal device 210 stores feedback information D5 in RAM area in control section 212 of in-vehicle terminal device 210 (step S805). Then, in accordance with display selection information D7, control section 212 displays the content representing feedback information D5 on display section 111 (step S806).

Figure 19:
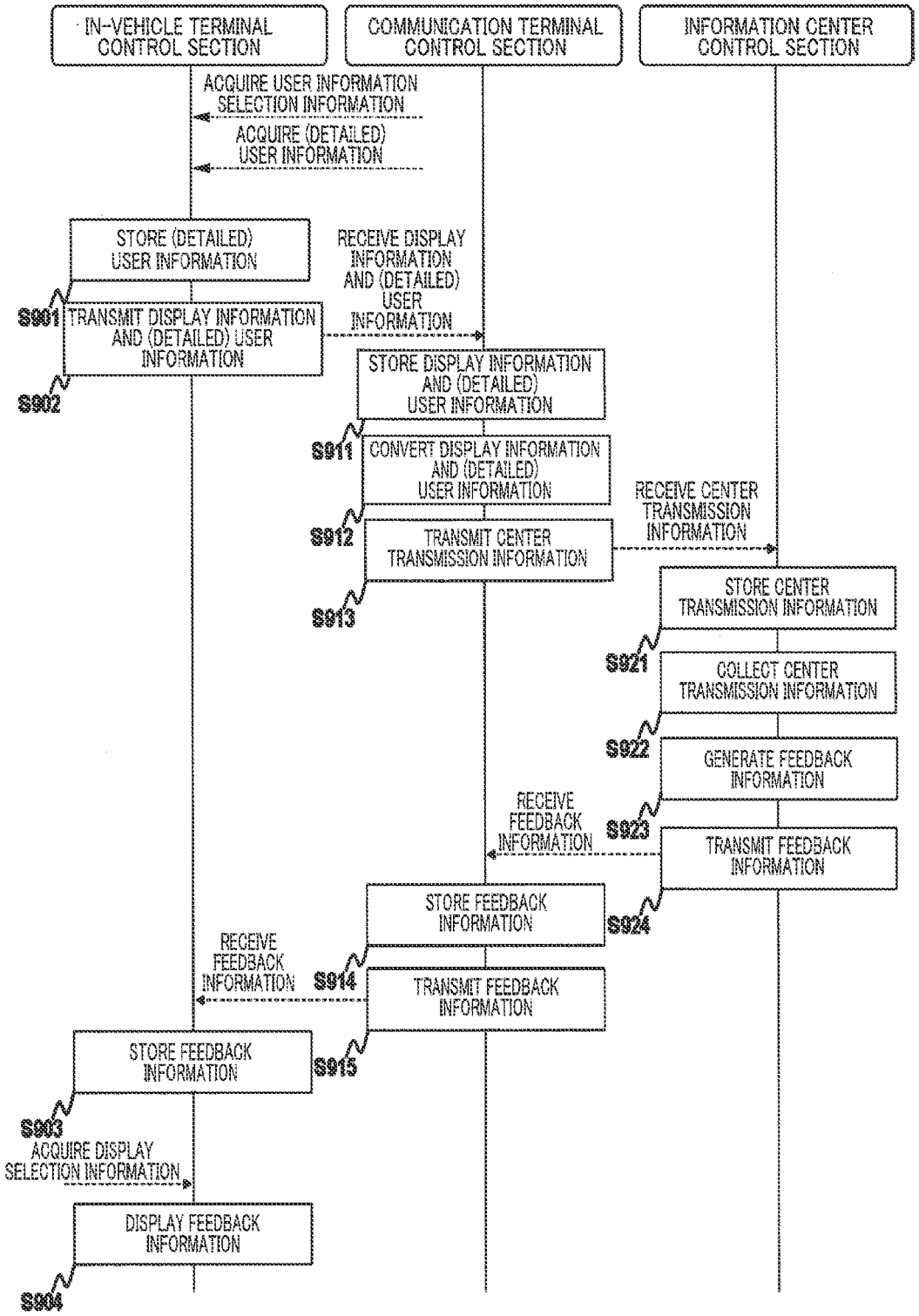
FIG. 19 is a flow chart for describing a transmission of detailed user information D3, and a reception of feedback information D5 in information system 200 in Embodiment 2 of the present invention.

FIG. 19 is a flow chart of a transmission of detailed user information D3 and a reception of feedback information D5 in information system 200 in Embodiment 2 of the present invention. First, with reference to FIG. 19, a flow of the whole process of information system 200 is described.

As illustrated in FIG. 19, upon acquiring user information selection information D6 and detailed user information D3, control section 212 of in-vehicle terminal device 210 stores the information in the RAM area (step S901), and transmits the information to control section 221 of communication terminal device 220 (step S902).

Upon receiving detailed user information D3 and display information D8, control section 221 of communication terminal device 220 stores the information in the RAM area (step S911), and converts the information into center transmission information D4 (step S912). Then, control section 221 establishes a communication between wireless communication section 122 of communication terminal device 220 and wireless communication section 132 of information center 130, to thereby transmit center transmission information D4 to control section 131 of information center 130 (step S913).

Upon receiving center transmission information D4, control section 131 of information center 130 stores the information in the RAM area (step S921), collects the information on the basis of center transmission information D4 transmitted from a plurality of vehicles (step S922), and generates feedback information D5 (step S923). Then, control section 131 establishes a communication between wireless communication section 132 of information center 130 and wireless communication section 122 of communication terminal device 220, to thereby transmit feedback information D5 to control section 121 of communication terminal device 220 (step S924).

Upon receiving feedback information D5 from information center 130, control section 221 of communication terminal device 220 stores the information in the RAM area (step S914), and transmits the information to control section 212 of in-vehicle terminal device 210 (step S915).

Upon receiving feedback information D5 from information center 130 through communication terminal device 220, control section 212 of in-vehicle terminal device 210 stores feedback information D5 in the RAM area in control section 212 of in-vehicle terminal device 210 (step S903). Then, in accordance with display selection information D7, control section 212 controls display section 111 to display the content representing feedback information D5 (step S904).

Figure 20:
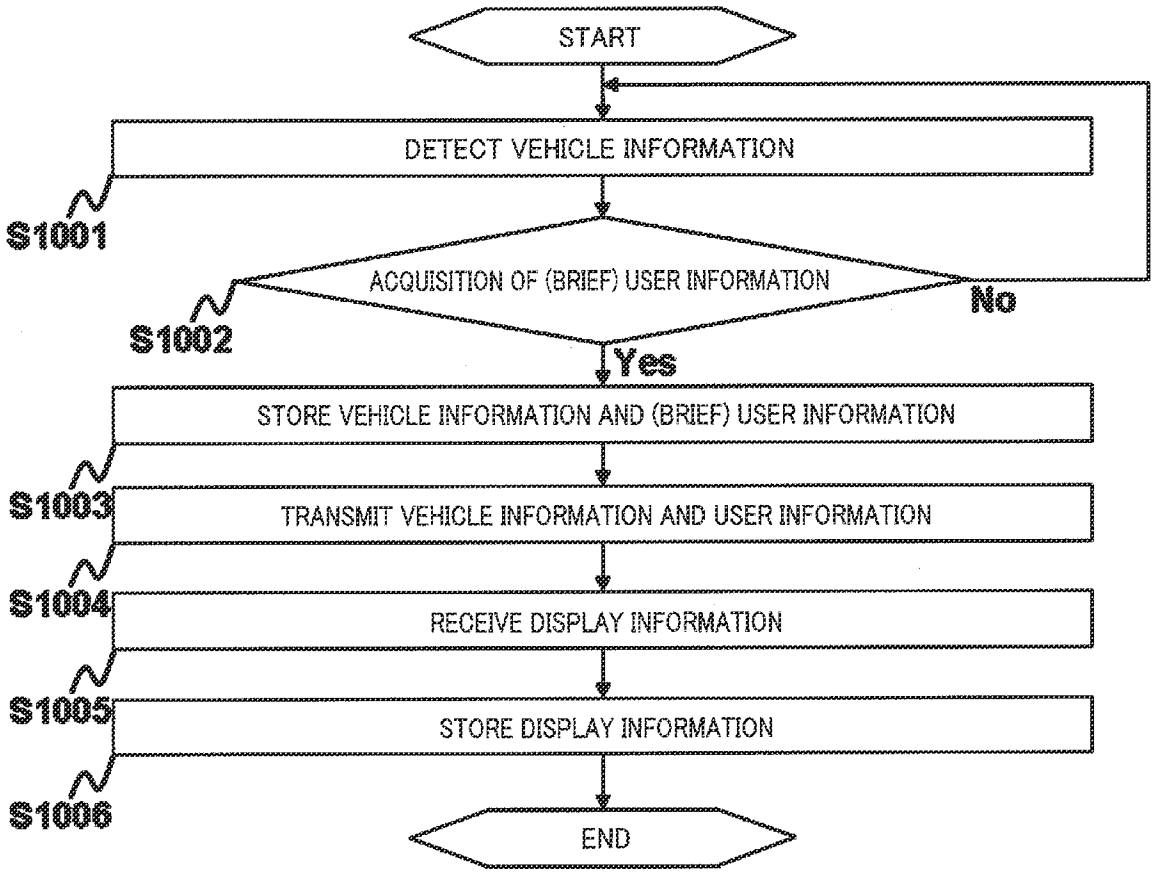
FIG. 20 is a flow chart for describing a transmission of brief user information D3 in in-vehicle terminal device 210 in Embodiment 2 of the present invention.
Figure 21:
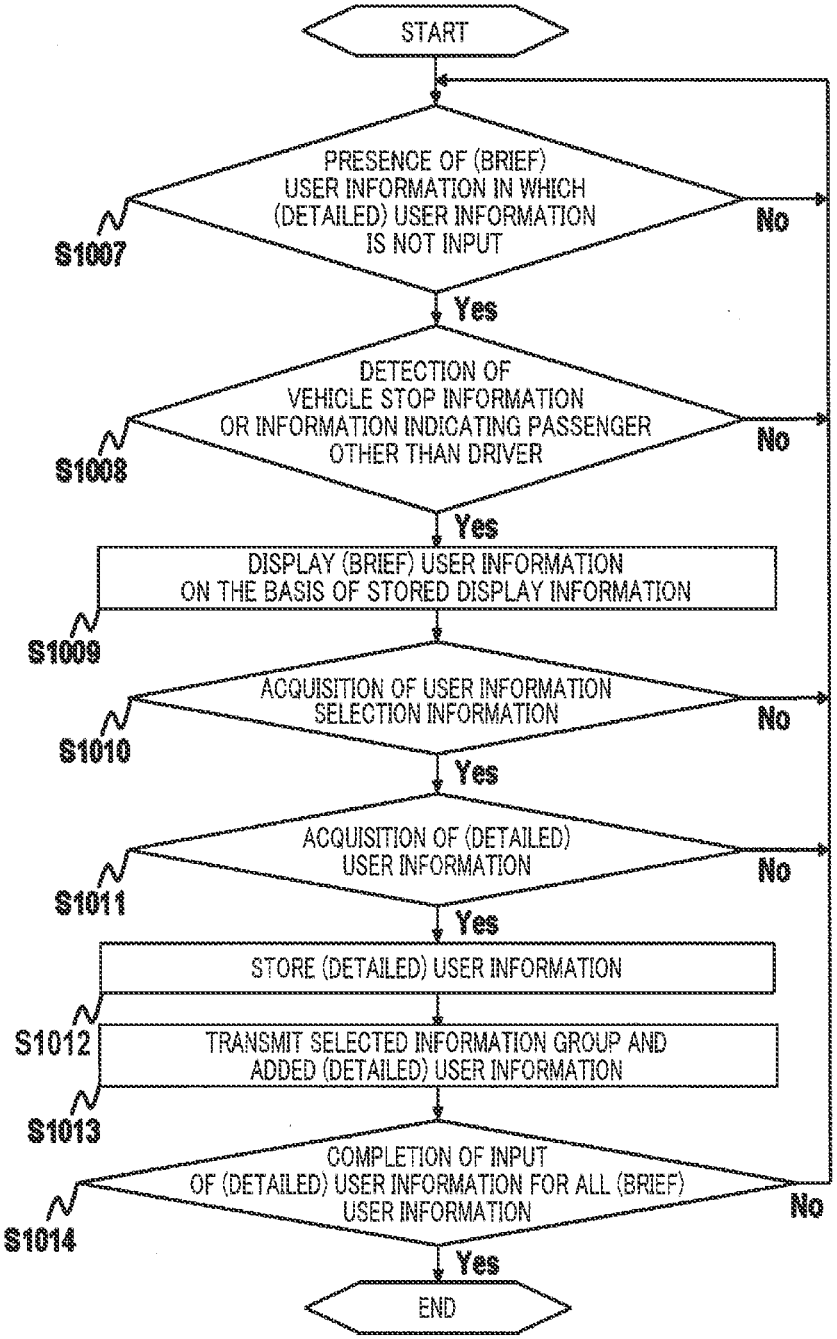
FIG. 21 is a flow chart for describing a transmission of detailed user information D3 in in-vehicle terminal device 210 in Embodiment 2 of the present invention.
Figure 22:
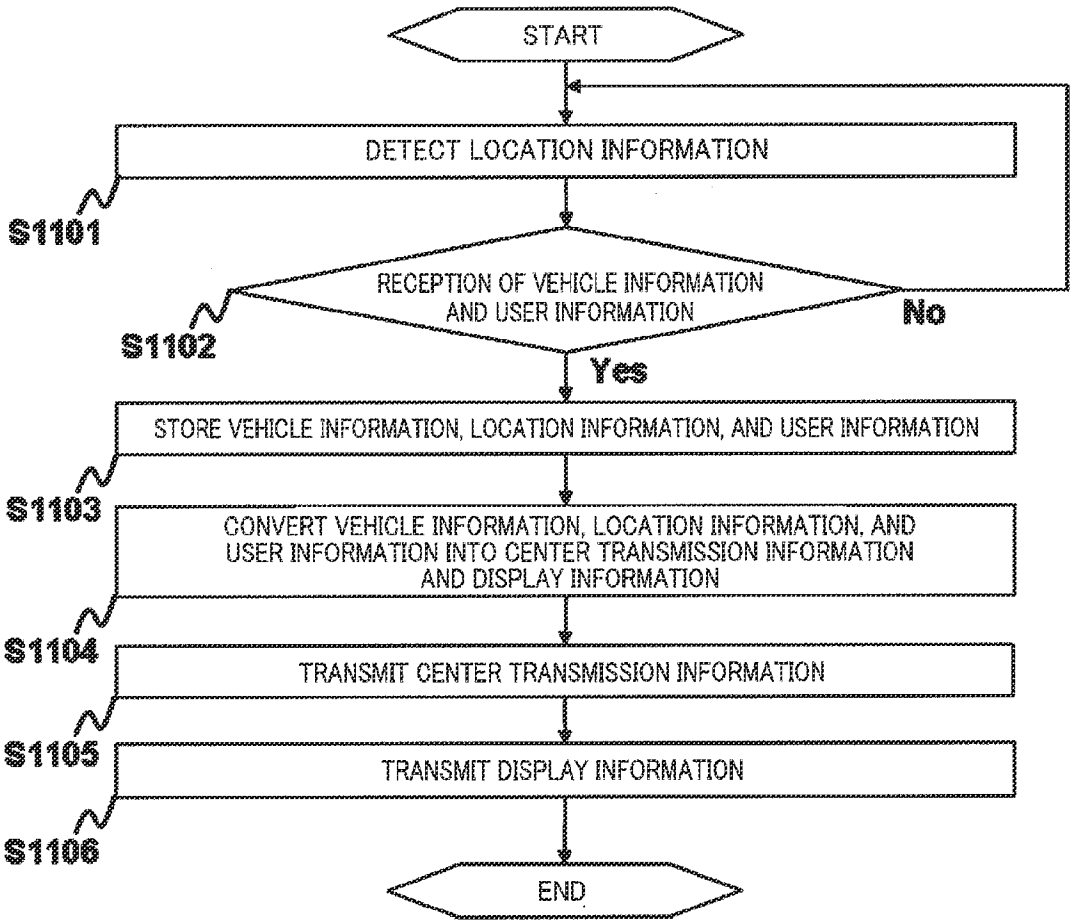
FIG. 22 is a flow chart for describing a transmission of center transmission information D4 in communication terminal device 220 in Embodiment 2 of the present invention.

Next, the flows of the processing of control section 212 of in-vehicle terminal device 210 and control section 221 of communication terminal device 220 illustrated in FIGS. 20, 21, and 22 are separately described in detail.

FIG. 20 is a flow chart of a transmission of brief user information D3 executed by control section 212 of in-vehicle terminal device 210. FIG. 21 is a flow chart of a transmission of detailed user information D3 executed by control section 212 of in-vehicle terminal device 210.

The flow of FIG. 20 is now described. First, control section 212 detects vehicle information D1 (step S1001), and determines whether brief user information D3 has been input by the user as a vehicle passenger (step S1002). It is to be noted that the processes of step S1001 and step S1002 may be reversed.

When the result of the determination process at step S1002 is "Yes," in other words, when brief user information D3 input by the user has been acquired, the operation is performed as follows. Control section 212 stores detected vehicle information D1 and acquired user information D3 in its RAM area (step S1003), and transmits the information to control section 221 of communication terminal device 220 (step S1004). It is to be noted that when brief user information D3 cannot be acquired (No at step S1002), the process is returned to step S1001, in other words, the process of detecting vehicle information D1.

Subsequent to step S1004, upon receiving display information D8 from communication terminal device 220 (step S1005), control section 212 of in-vehicle terminal device 210 stores display information D8 in the RAM area (step S1006).

The flow of FIG. 21 is now described. First, control section 212 determines whether brief user information D3 included in display information D8 in which detailed user information D3 is not input is stored (step S1007).

When the result of the determination process at step S1007 is "Yes," in other words, when brief user information D3 included in display information D8 is stored in the RAM area of control section 212 of in-vehicle terminal device 210, the operation is performed as follows. Control section 212 determines whether information indicating that the vehicle is stopped is detected from the vehicle speed information in vehicle information D1, or determines whether a vehicle passenger other than the driver is detected from information from the seating sensor in vehicle information D1 (step S1008).

When the result at step S1008 is "Yes," in other words, when information indicating that the vehicle is stopped is detected from the vehicle speed information, or when a vehicle passenger other than the driver is detected by the seating sensor, the operation is performed as follows. Control section 212 displays brief user information D3 on display section 111 on the basis of information D8 stored in its RAM area (step S1009).

It should be noted that, when the result at step S1007 or step S1008 is "No," the process is returned to step S1007.

When brief user information D3 is displayed at step S1009, the user as a vehicle passenger can perform an input operation by utilizing user interface section 113.

Here, when the user performs the input operation, control section 212 acquires user information selection information D6 (step S1010), and determines whether detailed user information D3 input by the user as a vehicle passenger can be acquired (step S1011).

When it is determined at step S1010 that user information selection information D6 cannot be acquired (No at step S1010), or when it is determined at step S1011 that detailed user information D3 cannot be acquired (No at step S1011), the process is returned to step S1007.

When it is determined at step S1011 that detailed user information D3 can be acquired (Yes at step S1011), control section 212 acquires detailed user information D3. Then, control section 212 stores acquired detailed user information D3 in its RAM area (step S1012), and transmits the information to control section 221 of communication terminal device 220 (step S1013).

Then, control section 212 determines whether the user has completed the input of detailed user information D3 for all brief user information D3 (step S1014).

When detailed user information D3 has not been acquired for brief user information D3 stored in the RAM area of control section 212 (No at step S1014), the operation is performed as follows. The process is returned to step S1007, in other words, the process for determining whether brief user information D3 is stored.

It should be noted that, when the result at step S1014 is "No," it can be said that brief user information D3 is stored, and the process may be returned to step S1008 when the result at step S1014 is "No." That is, the process may be returned to the process of detecting information indicating that the vehicle is stopped from the vehicle speed information in vehicle information D1, or the process of detecting a vehicle passenger other than the driver from the information from the seating sensor in vehicle information D1.

When detailed user information D3 is acquired for all of brief user information D3 stored in the RAM area of control section 212 (Yes at step S1014), the process is terminated.

It is to be noted that the relationship between the flow chart of a transmission of brief user information D3 illustrated in FIG. 20, and the flow chart of a transmission of detailed user information D3 illustrated in FIG. 21 is that the process is advanced from the process of transmitting brief user information D3 to the process of transmitting detailed user information D3, in a predetermined case. Here, the "predetermined case" is a case where information indicating that the vehicle is stopped is detected from the vehicle speed information in vehicle information D1, or a case where a vehicle passenger other than the driver is detected from information from the seating sensor in vehicle information D1, when brief user information D3 is stored in the RAM area of control section 212 of in-vehicle terminal device 210.

It is to be noted that an interrupt may be adopted for transferring the process from the process of transmitting brief user information D3 to the process of transmitting detailed user information D3.

Next, with reference to FIG. 22, the flow of the process of communication terminal device 220 is described. FIG. 22 is a flow chart of a transmission of center transmission information D4 in control section 221 of communication terminal device 220.

As illustrated in FIG. 22, control section 221 of communication terminal device 220 detects location information D2 (step S1101), and sequentially determines whether vehicle information D1 and user information D3 have been received from control section 212 of in-vehicle terminal device 210 (step S1102). It is to be noted that the processes of step S1101 and step S1102 may be reversed.

When it is determined at step S1102 that pieces of information (D1, D3) have been received (Yes at step S1102), the operation is performed as follows. Control section 221 stores pieces of information (D1 to D3) in its RAM area (step S1103), and converts vehicle information D1, location information D2 and user information D3 into center transmission information D4 and display information D8 (step S1104). Then, through wireless communication section 122 of communication terminal device 220, control section 221 transmits center transmission information D4 to information center 130 (step S1105), transmits display information D8 to control section 212 of in-vehicle terminal device 210 (step S1106), and terminates the process. It is to be noted that, when it is not determined at step S1102 that pieces of information (D1, D3) have been received (No at step S1102), control section 221 returns to the process of step S1101.

As described above, an in-vehicle terminal device of the embodiments of the present invention transmits information to an information center through a communication terminal device connected to a subject device, the in-vehicle terminal device including: a location information detection section that detects location information of a vehicle in which the subject device is mounted; a user interface section from which a user performs an input operation; a vehicle information detection section that detects vehicle speed information of the vehicle in which the subject device is mounted or a seated person in the vehicle; a notification section that provides options for the input operation of the user; and a control section that associates location information detected by the location information detection section with information input from the user interface section, and outputs the location information detected by the location information detection section and the information input from the user interface section associated with each other, wherein the control section changes content provided by the notification section in accordance with vehicle information detected by the vehicle information detection section.

Here, the "options for the input operation of the user" means the "Good" and "Bad" described in the above-mentioned embodiments, and the options are not limited to the above-mentioned examples, and words, icons, symbols and the like representing intentions to be input by the users may be appropriately utilized.

Here, as described in the above-mentioned embodiment, the "notification" means informing the user by applying on and off of a light source (illumination) to a switch, by displaying on a screen, or by sound.

In the in-vehicle terminal device of embodiments of the present invention, since the content to be notified by the notification section is changed in accordance with vehicle information, a brief content is notified (presented) to the user while the vehicle is travelling so that the user promptly performs an input operation, and detailed user information relating to the information is notified after the vehicle is stopped or notified by a passenger other than the driver. Thus, the user can input detailed information with ease.

Thus, real time input of information representing evaluation and impression of the user on the surrounding condition and circumstance during traveling (road condition and congestion) is achieved, and thus information on the evaluation of the user with high accuracy can be obtained.

Further, when it is desired to input more detailed evaluation than the evaluation input by the user while travelling, evaluation information can be input after the vehicle is stopped, or can be input by a passenger other than the driver with case.

It is to be noted that the in-vehicle terminal device of the embodiments of the present invention may have the following configurations in accordance with the function of the communication terminal device to be connected (function for detecting location information).

Specifically, an in-vehicle terminal device of embodiments of the present invention transmits information to an information center through a communication terminal device configured to acquire location information, the in-vehicle terminal device including: a user interface section from which a user performs an input operation; a vehicle information detection section that detects vehicle speed information of a vehicle in which a subject device is mounted or a seated person in the vehicle; a notification section that provides options for the input operation of the user; and a control section that outputs information input from the user interface section to the communication terminal, wherein the control section changes content provided by the notification section in accordance with vehicle information detected by the vehicle information detection section.

In this case, by establishing a connection with the communication terminal device that can detect location information, the control section of the communication terminal device can associate location information detected by the communication terminal device with information input from the user interface section and can output the associated information, and therefore an device provided with no location information detection function (for example, a display audio or a meter display) can be utilized as the in-vehicle terminal device.

In the in-vehicle terminal device of the embodiments of the present invention, the configuration "changes content provided by the notification section in accordance with vehicle information" includes the following three configurations as described in the above-mentioned embodiments.

Specifically, as the first example, the user interface section is a steering switch provided on a steering device of the vehicle, the notification section is a light source that lights the steering switch, and the control section switches between on and off of the light source in accordance with a vehicle speed set in advance.

Here, "steering switch provided on a steering device of the vehicle" may not be integral with the steering device, and the switch only has to be easily visually confirmed by the driver and provided around the steering device. Further, the switch may be detachably provided to the steering device.

In addition, the steering switch may be composed of a light transmissive member in which an LED or another light source is provided. Alternatively, the steering switch may be composed of, in place of the light transmissive member, a touch panel with a liquid crystal or an organic electroluminescent (EL) display.

Further, the configuration of "switches between on and off of the light source" which means the configuration "changes content provided" includes not only switching between ON/OFF of the light source, but also blinking, flicking and changing the frequency of blinking or flicking.

In this configuration, since the notification section and the user interface section are disposed at a position near the range of view of the driver and hands of the driver of the vehicle, the configuration is useful in the case where the driver performs an input operation.

As the second example, the user interface section is a touch panel, the notification section is a display provided on the back face of the touch panel, and the control section changes content displayed on the display in accordance with a vehicle speed set in advance.

In this case, the configuration "changes content displayed on the display" which means the configuration "changes content provided" includes not only changing the color, brightness, or size of the buttons displayed on the display, but also changing the form, and expression using animation.

In this configuration, since the notification section and the user interface section are disposed at a position near the range of view of the driver and hands of the driver of the vehicle, the configuration is useful in the case where the driver and, in particular, the passenger perform an input operation.

As the third example, the user interface section is a microphone, the notification section is a speaker, and the control section changes sound content output from the speaker in accordance with a vehicle speed set in advance.

Here, the "microphone" may not be integral with the in-vehicle terminal device, and the microphone only has to be provided at a position where the sound output by the driver can be caught. For example, "microphone" may be detachably provided in the in-vehicle terminal device, a dedicated microphone may be provided as a user interface section, or a microphone function provided in a mobile phone or a smartphone may be utilized.

In addition, while a dedicated speaker may be provided as the "speaker," space-saving of the vehicle interior can be achieved and clear sound can be obtained when a speaker fixed in the vehicle is used. Alternatively, the speaker function provided in a mobile phone or a smartphone may be utilized.

In the third example, "changes sound content output from the speaker" which means the configuration "changes content provided" is not limited to changing spoken languages such as "Good" and "Bad." For example, it is also possible to switch between a male voice and a female voice, or between a low-pitched sound and a high-pitched sound, and further, the combinations thereof may be used.

With this configuration, since the notification section and the interface section are disposed regardless of the positions of all the passengers in the vehicle, this configuration is useful in the case where all passengers in the vehicle perform an input operation. In the in-vehicle device of the embodiment of the present invention, in the case where the control section "changes content provided by the notification section in accordance with vehicle information detected by the vehicle information detection section," the vehicle information detection section includes the following configurations.

Specifically, a configuration in which the vehicle information detection section detects a speed of the vehicle in which the subject device is mounted; and the control section determines whether the vehicle is stopped or traveling on a basis of the speed detected by the vehicle information detection section, and changes the content provided by the notification section.

In addition, a configuration in which the vehicle information detection section detects an operation state of a parking brake of the vehicle in which the subject device is mounted; and the control section determines whether the vehicle is stopped or traveling on a basis of the operation state of the parking brake detected by the vehicle information detection section, and changes the content provided by the notification section.

It should be noted that, the above-mentioned two configurations may be combined to enhance the accuracy of the determination whether "vehicle is stopped or traveling."

Alternatively, in the case where the control section "changes content provided by the notification section in accordance with vehicle information detected by the vehicle information detection section," it is possible to adopt a configuration in which the vehicle information detection section detects a state of a seating sensor of the vehicle in which the subject device is mounted; and the control section determines whether a passenger is present or not in a front passenger seat or a rear seat of the vehicle on a basis of the state of the seating sensor detected by the vehicle information detection section, and changes the content provided by the notification section. Here, as the seating sensor, a dedicated component such as a piezoelectric element provided under the seat may be provided, and a function for detecting the use of a seat belt may be utilized.

The in-vehicle terminal device of the embodiments of the present invention having the above-mentioned configuration is applicable to the following system.

Specifically, an information system including an in-vehicle terminal device that outputs information obtained by an input operation performed by a user, a communication terminal device that transmits to an outside information output from the in-vehicle terminal device, an information center that sorts (or collects statistics) and delivers information received from the in-vehicle terminal device, wherein the in-vehicle terminal device changes a detail level of information used for the input operation of the user according to a speed of a vehicle in which a subject device is mounted or according as a seated person other than a driver is present in the vehicle or not.

It should be noted that the "outside" to which the communication terminal device transmits information is not limited to the information center, and may be a base station used for communication of mobile phones or an access point used for wireless LAN communication. The information transmitted by the communication terminal device is transmitted to the information center via the base station or the access point.

With the information system having the above-mentioned configuration, the user on the vehicle side can voluntarily transmits information to the information center, and thus, improvement of the accuracy of the evaluation information by the user and real time information update can be achieved.

INDUSTRIAL APPLICABILITY

The in-vehicle terminal device, the communication terminal device, and the information center of the embodiments the present invention allow for utilization of highly accurate information (with a real time property) about user evaluations on surrounding conditions and circumstances of traveling vehicles, and therefore are useful as an information system.

REFERENCE SIGNS LIST

100 Information system
110 In-vehicle terminal device
111 Display section
112 Control section
113 User interface section
114 Vehicle information detection section
115 Location information detection section
120 Communication terminal device
121 Control section
122 Wireless communication section
130 Information center
131 Control section
132 Wireless communication section
200 Information system
210 In-vehicle terminal device
212 Control section
220 Communication terminal device
221 Control section
223 Location information detection section
D1 Vehicle information
D2 Location information
D3 User information
D4 Center transmission information
D5 Feedback information
D6 User information selection information
D7 Display selection information
D8 Display information

The invention claimed is:

1. An in-vehicle terminal device that transmits information to an information center through a communication terminal device connected to the in-vehicle terminal, the in-vehicle terminal device comprising:

a user interface from which a user performs an input operation;

a vehicle information detector that detects vehicle speed information of a vehicle in which the in-vehicle terminal device is mounted;

a notification device that provides options for the input operation of the user; and a controller that outputs to the communication terminal device information input from the user interface, wherein the controller controls the notification device so as to provide options of user evaluation for the input operation to the user, wherein the options of user evaluation are predictable from the vehicle speed information detected by the vehicle information detector.

2. The in-vehicle terminal device according to claim 1, wherein:

the user interface is a steering switch provided on a steering device of the vehicle;

the notification device is a light source that lights the steering switch; and the controller controls to switch between on and off of the light source in accordance with a vehicle speed set in advance.

3. The in-vehicle terminal device according to claim 1, wherein:

the user interface is a touch panel;

the notification device is a display provided on a back surface of the touch panel; and the controller controls to change content displayed on the display in accordance with a vehicle speed set in advance.

4. The in-vehicle terminal device according to claim 1, wherein:

the user interface is a microphone;

the notification device is a speaker; and the controller controls to change sound content output from the speaker in accordance with a vehicle speed set in advance.

5. The in-vehicle terminal device according to claim 1, wherein:

the vehicle information detector detects an operation state of a parking brake of the vehicle in which the in-vehicle terminal device is mounted; and the controller controls the notification device on a basis of the operation state of the parking brake detected by the vehicle information detector.

6. An in-vehicle terminal device according to claim 1, further comprising:

a location information detector that detects location information of a vehicle in which the in-vehicle terminal device is mounted, wherein the controller associates location information detected by the location information detector with information input from the user interface, and outputs the location information and the information input associated with each other to the communication terminal device.

7. An in-vehicle terminal device according to claim 1, wherein:

information input from the user interface is associated with location information detected by the communication terminal device, and the location information and the information input are associated with each other and output to the information center.

8. An in-vehicle terminal device according to claim 1, wherein:

the controller controls the notification device so as to provide emphasized options of user evaluation for the input operation to the user, wherein the options of user evaluation are predictable from the vehicle speed information detected by the vehicle information detector.

9. An in-vehicle terminal device according to claim 1, wherein:

the controller controls the notification device so as to provide emphasized options of user evaluation based on a prediction from the vehicle speed information detected by the vehicle information detector, for the input operation to the user.

10. An in-vehicle terminal device according to claim 1, wherein:

the controller controls the notification device so as to provide an order of options of user evaluation based on a prediction from the vehicle speed information detected by the vehicle information detector, for the input operation to the user.

11. An in-vehicle terminal device according to claim 1, wherein:

the controller controls the notification device so as to provide an order of options of user evaluation for the input operation to the user on a basis of statistic information of the information center, the statistic information being detected by the vehicle information detector.

12. An information system comprising:

a communication terminal device;

an information center; and an in-vehicle terminal comprising:

a user interface from which a user performs an input operation;

a vehicle information detector that detects vehicle speed information of a vehicle in which the in-vehicle terminal device is mounted;

a notification device that provides options for the input operation of the user; and a controller that outputs to the communication terminal device information input from the user interface, wherein the controller controls the notification device so as to provide options of user evaluation for the input operation to the user, wherein the options of user evaluation are predictable from the vehicle speed information detected by the vehicle information detector, wherein the communication terminal device transmits information output from the in-vehicle terminal device to the information center, and wherein the information center sorts and delivers information received from the in-vehicle terminal device.

13. A method that transmits information to an information center through a communication terminal device connected to an in-vehicle terminal, the method comprising:

detecting vehicle speed information of a vehicle in which the in-vehicle terminal device is mounted;

providing options for an input operation of an user;

outputting information input from an user interface to the communication terminal; and controlling to provide options of user evaluation for the input operation to the user, wherein the options of user evaluation are predictable from the vehicle speed information.

* * * * *